US006982393B2

(12) United States Patent
Matsui et al.

(10) Patent No.: US 6,982,393 B2
(45) Date of Patent: Jan. 3, 2006

(54) LEVER FITTING-TYPE POWER SUPPLY CIRCUIT BREAKER

(75) Inventors: Tsuyoshi Matsui, Aichi (JP); Hideomi Adachi, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/983,711

(22) Filed: Nov. 9, 2004

(65) Prior Publication Data

US 2005/0098419 A1 May 12, 2005

(30) Foreign Application Priority Data

Nov. 10, 2003 (JP) ..... P2003-379639

(51) Int. Cl.
*H01H 3/04* (2006.01)

(52) U.S. Cl. ..... 200/335; 200/332; 439/157

(58) Field of Classification Search . 200/329–335,343, 200/557–559, 61.7; 439/157
See application file for complete search history.

(56) References Cited

U.S. PATENT DOCUMENTS 5,727,959 A * 3/1998 Yagi et al. ..... 439/157
5,880,927 A * 3/1999 Kent et al. ..... 361/634
6,224,403 B1 * 5/2001 Okabe ..... 439/157
6,353,196 B2 * 3/2002 Niinuma et al. ..... 200/335
6,580,045 B1 * 6/2003 Kuo ..... 200/559

FOREIGN PATENT DOCUMENTS

JP 2002-343169 11/2002

* cited by examiner

*Primary Examiner*—Richard K. Lee
(74) *Attorney, Agent, or Firm*—Finnegan, Henderson, Farabow, Garrett & Dunner, L.L.P.

(57) ABSTRACT

Power terminals constituting a power switch are provided in both of connector housings, respectively. Fitting sensing terminals forming a fitting sensing switch are provided in a lever attached to the one connector housing and the other connector housing. When the lever is operated from an operation start position to an operation completion position, the power terminals are brought into contact with each other to turn ON the power switch, and thereafter, both of the fitting sensing terminals are brought into contact with each other to turn ON the fitting sensing switch, and a power supply circuit is brought into a conductive state by the turning ON of the fitting sensing switch. The fitting sensing terminal provided in the other connector housing is formed of a pair of male terminals utilizing bus bars, and the fitting sensing terminal provided in the lever is formed of a short pin formed into a substantially U-shape.

4 Claims, 30 Drawing Sheets

LEVER FITTING-TYPE POWER SUPPLY CIRCUIT BREAKER

BACKGROUND OF THE INVENTION

1. Field of the Invention

The present invention relates to a lever fitting-type power supply circuit breaker which fits one of connector housings to the other connector housing and releases such fitting on the contrary by operating a lever with low operating force by utilizing a cam mechanism.

2. Description of the Related Art

In an electric vehicle, a capacity of a power supply which is a battery is larger as compared with that of a battery of a usual gasoline engine vehicle and the like. Accordingly, in such a case of maintaining an electrical system and the like of the electric vehicle, a power supply circuit is opened by a circuit breaker, and safety during work is ensured. As such a type of the conventional lever fitting-type power supply circuit breaker, there is one shown in FIGS. 1A to 13 (Japanese Patent Application Laid-Open No. 2002-343169).

As shown in FIGS. 10 to 13, this lever fitting-type power supply circuit breaker 100 includes one connector housing 101, a lever 102 attached to the one connector housing 101, and the other connector housing 103 to which the one connector housing 101 is attached by an operation of the lever 102.

As shown in FIGS. 1A, 1B, and 4 to 6B, the one connector housing 101 includes a housing body 104, and a cover 105 attached to the housing body 104 so as to close an upper portion of the housing body 104. A terminal hood portion 108 is provided under the housing body 104, and a pair of male terminals 109 and 109 (shown in FIGS. 5 and 6B) are provided in the terminal hood portion 108 in a state of being protruded downward. The pair of male terminals 109 and 109 are electrically connected to each other through a fuse 110 (shown in FIG. 6A) housed in the housing body 104.

A pair of guide pins 111 and 111 are protruded from outer walls of the housing body 104, and guide grooves 120 of the lever 102, which are described later, are individually engaged with the guide pins 111 and 111.

A pair of lever-path adjusting guide grooves 115 and 115 are provided on the outer walls of the housing body 104. One of step side faces (denoted by reference numeral 115*a*) forming the respective lever-path adjusting guide grooves 115 and 115 is formed of a vertical step side face extended in a vertical direction, a horizontal step side face extended in a horizontal direction, and a circular arc step side face connecting these side faces in a circular arc shape. Then, with the pair of lever-path adjusting guide grooves 115 and 115, a pair of lever-path adjusting guide pins 124 and 124 of the other connector housing 103, which are described later, are engaged. Each of the pair of lever-path adjusting guide pins 124 and 124 is slid along the step side face 115*a* of each lever-path adjusting guide groove 115.

As shown in FIGS. 2 to 6B, the lever 102 includes a pair of arm plate portions 118*a* and 118*b* arranged in parallel at an interval, and an operating portion 119 coupling the pair of arm plate portions 118*a* and 118*b* to each other. In the pair of arm plate portions 118*a* and 118*b*, the guide grooves 120 extended in the horizontal direction are provided at positions symmetric to each other. Into the respective guide grooves 120, the pair of guide pins 111 and 111 of the one connector housing 101 are individually inserted.

In the pair of arm plate portions 118*a* and 118*b*, cam grooves 121 are provided at positions symmetric to each other. Into the pair of cam grooves 121 and 121, cam pins 136 of the other connector housing 103, which are described later, are inserted. Moreover, the lever-path adjusting guide pins 124 are individually provided on inner walls of the pair of arm plate portions 118*a* and 118*b*. The pair of lever-path adjusting guide pins 124 and 124 are engaged with the pair of lever-path adjusting guide grooves 115 and 115 of the one connector housing 101.

Moreover, one of the pair of arm plate portions 118*a* and 118*b* is provided to be wider in width as compared with the other one. Specifically, the arm plate portion 118*b* is made wider. In the arm plate portion 118*b* wider in width, a connector portion 125 (shown in FIGS. 3A and 6B) is provided. In the connector portion 125, a fitting sensing male terminal 126 is provided.

As shown in FIGS. 7, 8A, 8B and the like, the other connector housing 103 has a substantially rectangular shape in which an upper surface is opened, and an inner space thereof serves as an attachment space 130 of the one connector housing 101. On a bottom surface portion 131 becoming a lower surface of the attachment space 130, terminal hood/housing portions 134 are integrally provided in a state of being protruded in the vertical direction. In the terminal hood/housing portions 134, female terminals 135 (shown in FIGS. 7, 8A and 8B) are individually housed. To the respective female terminals 135, one end sides of lead wires 139*a* are connected. One of the lead wires 139*a* and the other thereof are guided to a load unit 140 side of a power supply circuit B and a power supply unit 141 side of the power supply circuit B, respectively. Specifically, a power switch SW1 (shown in FIG. 9) of the power supply circuit B is composed of the male terminals 109 and female terminals 135 of both of the connector housings 101 and 103.

Moreover, from the symmetric positions of inner peripheral walls of the other connector housing 103, the pair of cam pins 136 and 136 are protruded. As described above, the pair of cam pins 136 and 136 are inserted into the cam grooves 121 of the lever 102 when the one connector housing 101 is attached to the other connector housing 103. Moreover, in the attachment space 130 of the other connector housing 103, a connector portion 137 is provided. In the connector portion 137, a pair of fitting sensing female terminals 138 and 138 are arranged. A fitting sensing switch SW2 (shown in FIG. 9) is composed of the pair of fitting sensing female terminals 138 and 138 and the fitting sensing male terminal 126 of the lever 102. The fitting sensing switch SW2 is turned ON in a manner that the male terminal 126 of the lever 2 is brought into contact with the pair of fitting sensing female terminals 138 and 138, and turned OFF in a non-contact state of the male terminal 126 of the lever 102. To the pair of female terminals 138 and 138, lead wires 139*b* are individually connected, and both of the lead wires 139*b* are guided to a relay circuit 142 of the power supply circuit B.

Next, the power supply circuit B is described. As shown in FIG. 9, the power supply circuit B includes the load unit 140, and the power supply unit 141 which supplies electric power to the load unit 140. To the load unit 140 and the power supply unit 141, the power switch SW1, which is formed of the terminals 109 and 135 of both of the connector housings 101 and 103, and the relay circuit 142, are connected in series. The relay circuit 142 is an electric circuit which is turned ON when the fitting sensing switch SW2 is ON and turned OFF when the fitting sensing switch SW2 is OFF. The power switch SW1 formed of the terminals 109 and 135 of both of the connector housings 101 and 103 is a mechanical switch as described above.

Next, an operation of the lever fitting-type power supply circuit breaker 100 is described with reference to FIGS. 10 to 13. FIG. 10 is a perspective view showing a state before the one connector housing 101 is temporarily fitted to the other connector housing 103. FIG. 11 is a perspective view showing a state where the one connector housing 101 is set at a temporal connector-fitting position of the other connector housing 103. FIG. 12 is a perspective view showing a state where the lever 102 is located at a rotation completing position in a process where the one connector housing 101 is fitted to the other connector housing 103. FIG. 13 is a perspective view showing a state where the fitting of the one connector housing 101 to the other connector housing 103 is completed.

First, an operation of bringing the power supply circuit B into a conductive state by the lever fitting-type power supply circuit breaker 100 is described. As shown in FIG. 10, the lever 102 is set at an operation start position, and the one connector housing 101 is inserted into the attachment space 103 from above the other connector housing 103. Then, as shown in FIG. 11, the terminal hood portion 108 of the one connector housing 101 is inserted into the terminal hood/housing portion 134 of the other connector housing 103 while being fitted thereto. Moreover, the pair of cam pins 136 and 136 of the other connector housing 103 are inserted into the pair of cam grooves 121 and 121 of the lever 102. Then, the pair of cam pins 136 and 136 enter the pair of cam grooves 121 and 121, and the one connector housing 101 and the other connector housing 103 are set at the temporal connector-fitting position.

Next, the lever 102 is rotated in a direction of an arrow A1 of FIG. 11. Then, the lever 102 is rotated about the pair of guide pins 111 and 111 from the operation start position of FIG. 11 to a rotation completion position of FIG. 12. By this rotation of the lever 102, the one connector housing 101 gradually approaches and enters the inside of the other connector housing 103. Then, the terminals 109 and 135 of both of the connector housings 101 and 103 are brought into contact with each other before the lever 102 is located at the rotation completion position, and at the rotation completion position of the lever 102, both of the connector housings 101 and 103 reach the connector-fitting position.

Next, when the lever 102 is slid in a direction of an arrow B1 of FIG. 12, the pair of guide pins 111 and 111 are slid in the pair of guide grooves 120 and 120 of the lever 102. In addition, the pair of cam pins 136 and 136 of the other connector housing 103 are slid in the pair of cam grooves 121 and 121 of the lever 102, and are located at a fitting completion position of FIG. 13. In this sliding process, the fitting sensing male terminal 126 of the lever 102 is brought into contact with the fitting sensing female terminals 138 and 138. Then, when the fitting sensing switch SW2 is turned ON, the relay circuit 142 is turned ON, and thus the power supply circuit B is brought into the conductive state for the first time.

Next, an operation of bringing the power supply circuit B in the conductive state into a non-conductive state (break of the power supply) by the lever fitting-type power supply circuit breaker 100 is described. In the state of FIG. 13, when the lever 102 located at the operation completion position is slid in a direction of an arrow B2 of FIG. 13, the pair of guide pins 111 and 111 are slid in the pair of guide grooves 120 and 120 of the lever 102, and the pair of cam pins 136 and 136 of the other connector housing 103 are slid in the pair of cam grooves 121 and 121 of the lever 102. Thus, the lever 102 is slid to the rotation completion position of FIG. 12. Before the lever 102 is located at the rotation completion position, the fitting sensing male terminal 126 of the lever 102 is separated from the pair of fitting sensing female terminals 138 and 138 of the other connector housing 103, and is brought into the non-contact state therewith. Then, when the fitting sensing switch SW2 is turned OFF, the relay circuit 142 is turned OFF, and at this point of time, the power supply circuit B has already been brought into the non-conductive state.

Next, when the lever 102 is rotated in a direction of an arrow A2 of FIG. 12, the lever 102 is rotated about the pair of guide pins 111 and 111 of the lever 102 to the operation start position of FIG. 11. Moreover, the pair of cam pins 136 and 136 of the other connector housing 103 are moved in the pair of cam grooves 121 and 121 of the lever 102, and thus the one connector housing 101 is gradually moved upward so as to be separated from the other connector housing 103, and is drawn therefrom. Then, before the lever 102 is located at the operation start position, the terminals 109 and 135 of both of the connector housings 101 and 103 are brought into the non-contact state with each other, and at the operation start position of the lever 102, both of the connector housings 101 and 103 are located at the temporal connector-fitting position.

As described above, in the lever fitting-type power supply circuit breaker 100, in the process of rotationally moving the lever 102 from the operation start position to the rotation completion position, the terminals 109 and 135 of both of the connector housings 101 and 103 are brought into the contact state with each other, and the power switch SW1 is tuned ON, but the power supply circuit B is still non-conductive. In the process of sliding (linearly moving) the lever 102 from the rotation completion position to the operation completion position, the fitting sensing switch SW2 is turned ON, and thus the relay circuit 142 is turned ON, and the power supply circuit B is brought into the conductive state for the first time. Therefore, the power supply circuit B can be prevented from being brought into the conductive state halfway through the operation of the lever 102. Hence, recognition that the power supply circuit B is still non-conductive because the operation of the lever 102 is not completed yet becomes reasonable, thus making it possible to prevent an occurrence of an accident. Moreover, when the power supply circuit B is switched from the conductive state to the non-conductive state, in the process of linearly moving the lever 102 from the operation completion position to the rotation completion position, the fitting sensing switch SW2 is turned OFF, and thus the relay circuit 142 is turned OFF, and the power supply circuit B is brought into the non-conductive state. In the process of rotationally moving the lever 102 from the rotation completion position to the operation start position, the power switch SW1 between both of the terminals 109 and 135 is brought into a separated state. Thus, there is a time lag from the time when the power supply circuit B is turned OFF to the time when the power switch SW1 between the terminals 109 and 135 is separated, and a discharge time is ensured. Therefore, an arc discharge can be prevented.

However, in the above-described conventional lever fitting-type power supply circuit breaker 100, the fitting sensing switch SW2 is formed into a so-called male-female terminal structure made of the fitting sensing male terminal 126 and the pair of fitting sensing female terminals 138 and 138, and is arranged in the connector portions 125 and 137, and accordingly, a large installation space is required. Therefore, there are problems that a width dimension W1 of the lever 102 and a width dimension of W2 of the other connector housing 103 are increased, and that the lever fitting-type power supply circuit breaker 100 becomes large.

SUMMARY OF THE INVENTION

In this connection, the present invention is one created in order to solve the above-described problems. It is an object of the present invention to provide a lever fitting-type power supply circuit breaker including a power switch and a fitting sensing switch, which is capable of being downsized.

In order to achieve the above-described object, the present invention is a lever fitting-type power supply circuit breaker, including:

a first connector housing including a lever provided for moving between an operation start position and an operation completion position; and a second connector housing fittable to the first connector housing, wherein the first and second connector housings individually provide power terminals forming a power switch therein, fitting sensing terminals forming a fitting sensing switch are individually provided in the lever and the second connector housing, the fitting sensing terminal provided in the second connector housing is formed of a pair of male terminals, and the fitting sensing terminal provided in the lever is formed of a short pin, and when the lever is operated from the operation start position to the operation completion position in a state where the first and second connector housings are set at a temporal connector-fitting position, the first and second connector housings move from the temporal connector-fitting position to a connector-fitting position, and the power terminals are brought into contact with each other to turn ON the power switch, and thereafter, both of the fitting sensing terminals are brought into contact with each other to turn ON the fitting sensing switch, and a power supply circuit is brought into a conductive state by the turning ON of the fitting sensing switch.

With this configuration, the fitting sensing switch is composed of the pair of male terminals and the short pin, which can accordingly be installed in small installation spaces of the other connector housing and the lever, respectively. Hence, the other connector housing and the lever can be downsized, and eventually, the lever fitting-type power supply circuit breaker can be downsized. Moreover, a structure of the fitting sensing switch is simple, and accordingly, the fitting sensing switch can be manufactured at low cost.

In a preferred embodiment, the pair of male terminals may be formed by utilizing a pair of bus bars arranged in the second connector housing, the short pin may be formed into a substantially U-shape, and the short pin may sandwich the pair of male terminals from both outsides thereof to be brought into a conductive state thereto.

With this configuration, the short pin of the substantially U-shape sandwiches the pair of male terminals to contact the same male terminals, and accordingly, the short pin can be brought into contact with the male terminals with large pressing force. Therefore, a highly reliable conductive state can be obtained.

The lever may include a pair of arm plate portions arranged at an interval and an operating portion coupling the pair of arm plate portions to each other, and the short pin may be provided in the operating portion.

With this configuration, the short pin can be installed without increasing a width of the lever.

The movement of the lever from the operation start position to the operation completion position may be composed of a rotational movement and a linear movement, both of the power terminals may be brought into contact with each other in a process of the rotational movement, and the pair of male terminals and the short pin may be brought into contact with each other in a process of the linear movement.

With this configuration, an operation of the lever, which makes the power supply circuit conductive, is composed of two actions, which are the rotational operation and the linear operation, and the power supply circuit is made conductive by the latter linear operation. Moreover, an operation of the lever, which makes the power supply circuit non-conductive, is composed of the two actions performed reversely to the above, the power supply circuit is turned OFF by the former linear operation, and the power switch between the power terminals is turned OFF with delay by the following rotational operation. Therefore, a sufficient discharge time can be ensured.

BRIEF DESCRIPTION OF THE DRAWINGS

FIG. 1A is an exploded front view of one connector housing, and FIG. 1B is an exploded side view of the one connector housing.

FIG. 3A is a side view of the lever, and FIG. 3B is a cross-sectional view along a line 3B—3B in FIG. 3A.

FIG. 6A is a partially cutaway plan view of the one connector housing to which the lever is attached, and FIG. 6B is a bottom view of the one connector housing to which the lever is attached.

FIG. 8A is a plan view of the other connector housing, and FIG. 8B is a cross-sectional view along a line 8B—8B in FIG. 8A.

FIG. 14A is an exploded front view of one connector housing, and FIG. 14B is an exploded side view of the one connector housing.

FIG. 16A is a side view of the lever, and FIG. 16B is a cross-sectional view along a line 16B—16B of FIG. 16A.

FIG. 19A is a partially cutaway plan view of the one connector housing to which the lever is attached, and FIG. 19B is a bottom view of the one connector housing to which the lever is attached.

FIG. 21A is a plan view of the other connector housing, and FIG. 21B is a cross-sectional view along a line 21B—21B in FIG. 21A.

FIG. 29A is a front view showing a state where the lever is located between the operation start position and the rotation completion position, explaining a moving process of cam pins when the one connector housing is attached to the other connector housing; FIG. 29B is a front view showing a state where the lever is located at the rotation completion position, explaining the moving process of the cam pins when the one connector housing is attached to the other connector housing; and FIG. 29C is a front view showing a state where the lever is located at the operation completion position, explaining the moving process of the cam pins when the one connector housing is attached to the other connector housing.

FIG. 30A is a front view showing a state where the lever is located between the operation start position and the rotation completion position, explaining a moving process of lever-path adjusting guide pins when the one connector housing is attached to the other connector housing; FIG. 30B is a front view showing a state where the lever is located at the rotation completion position, explaining the moving process of the lever-path adjusting guide pins when the one connector housing is attached to the other connector housing; and FIG. 30C is a front view showing a state where the lever is located at the operation completion position, explaining the moving process of the lever-path adjusting guide pins when the one connector housing is attached to the other connector housing.

DETAILED DESCRIPTION OF THE PREFERRED EMBODIMENT

One embodiment of the present invention is described below with reference to the drawings.

Figure 14A:
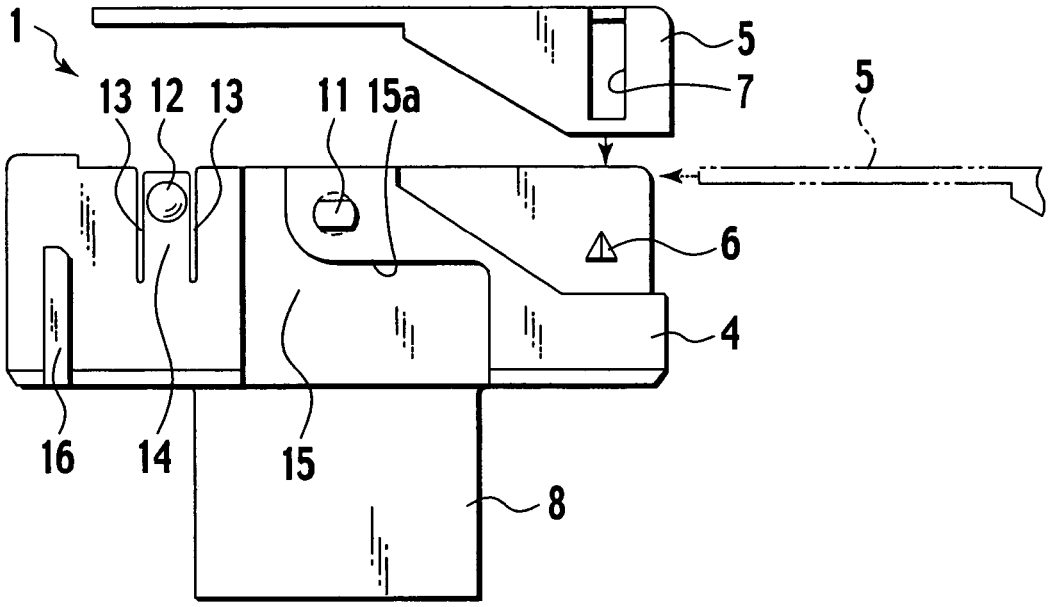
FIGS. 14A and 14B show one embodiment of the present invention.
Figure 14B:
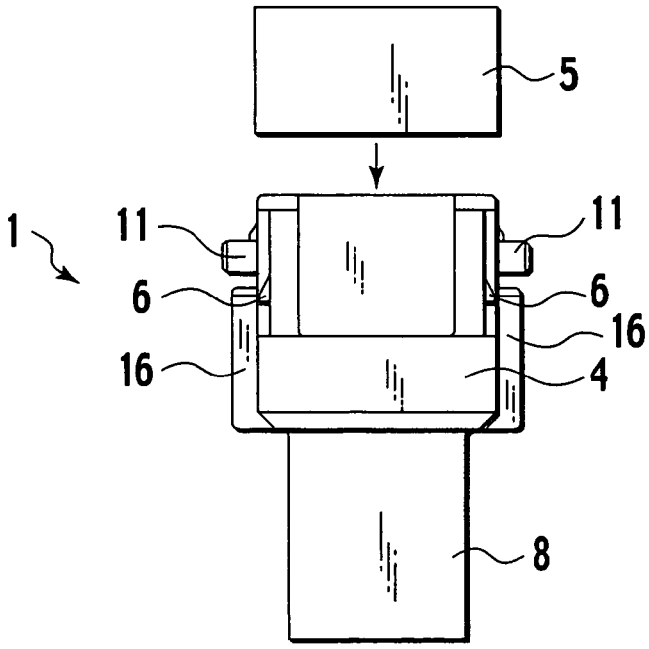
Figure 15:
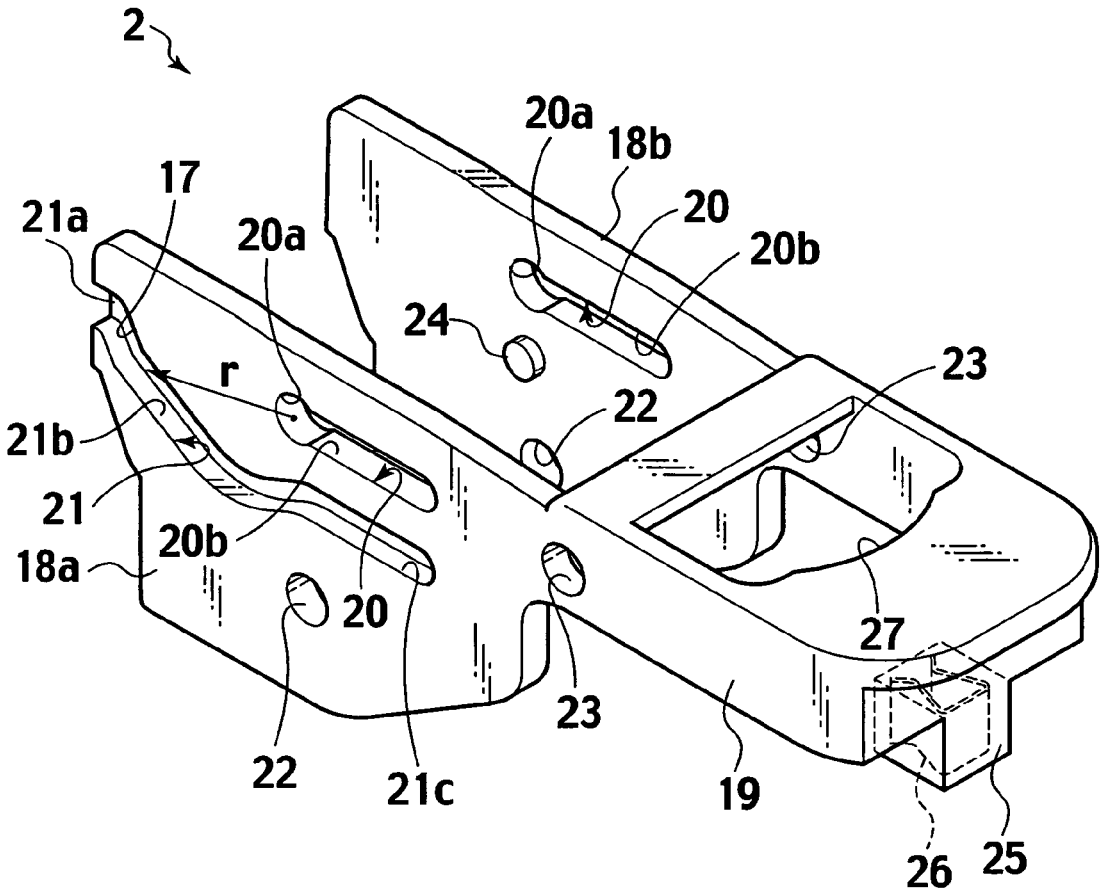
FIG. 15 shows the one embodiment of the present invention, and is a perspective view of a lever.
Figure 16A:
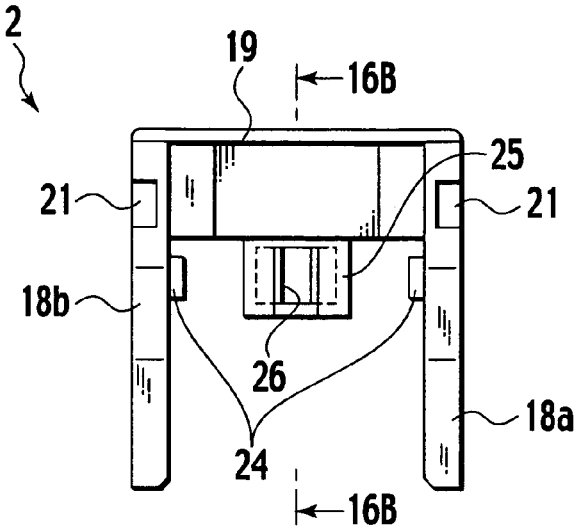
FIGS. 16A and 16B show the one embodiment of the present invention.
Figure 16B:
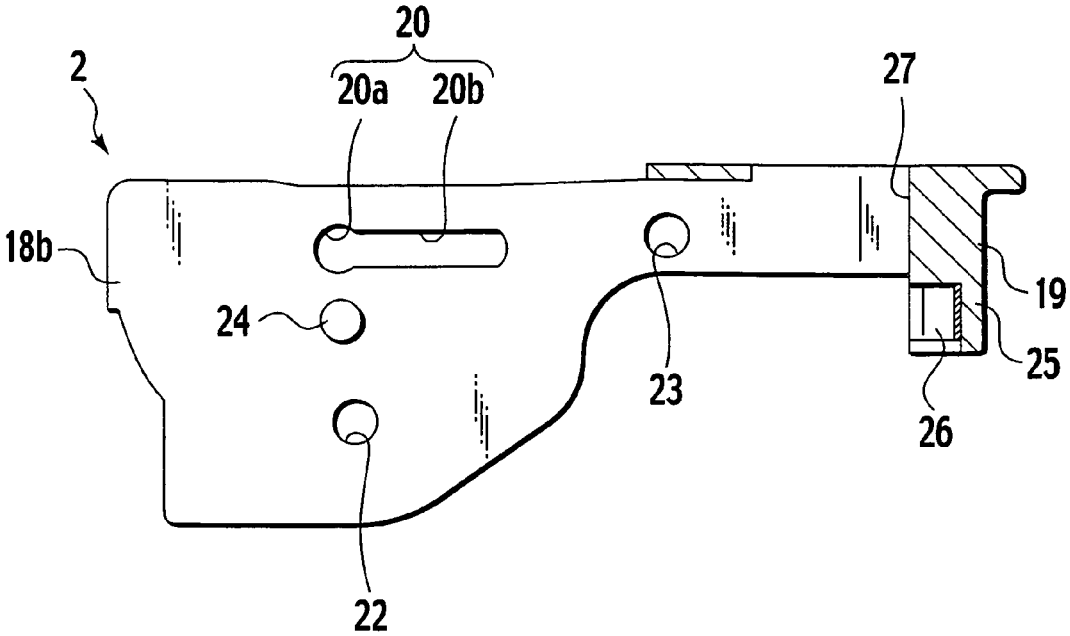
Figure 17:
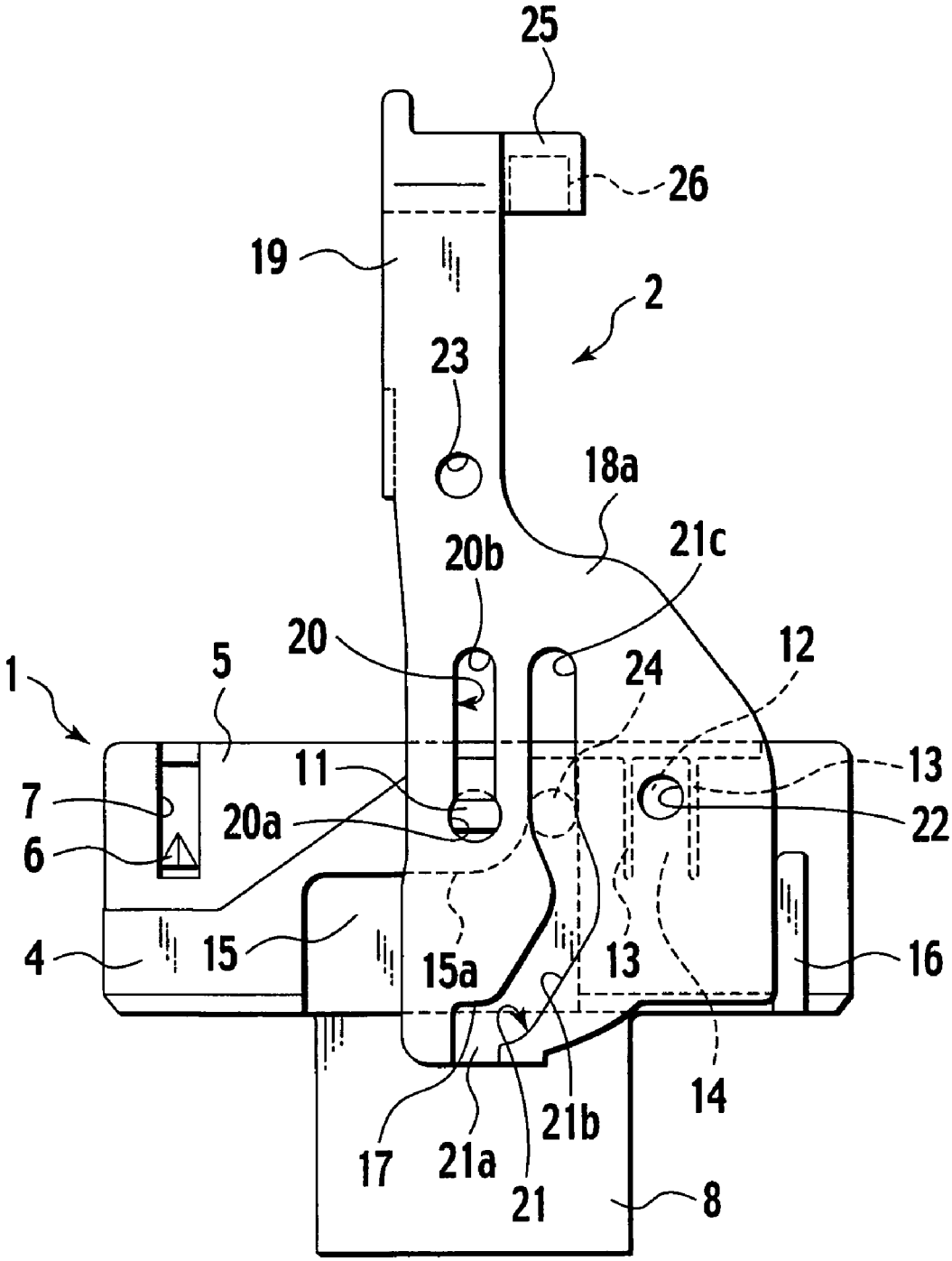
FIG. 17 shows the one embodiment of the present invention, and is a front view showing the one connector housing to which the lever is attached, in a state where the lever is located at a rotation start position.
Figure 18:
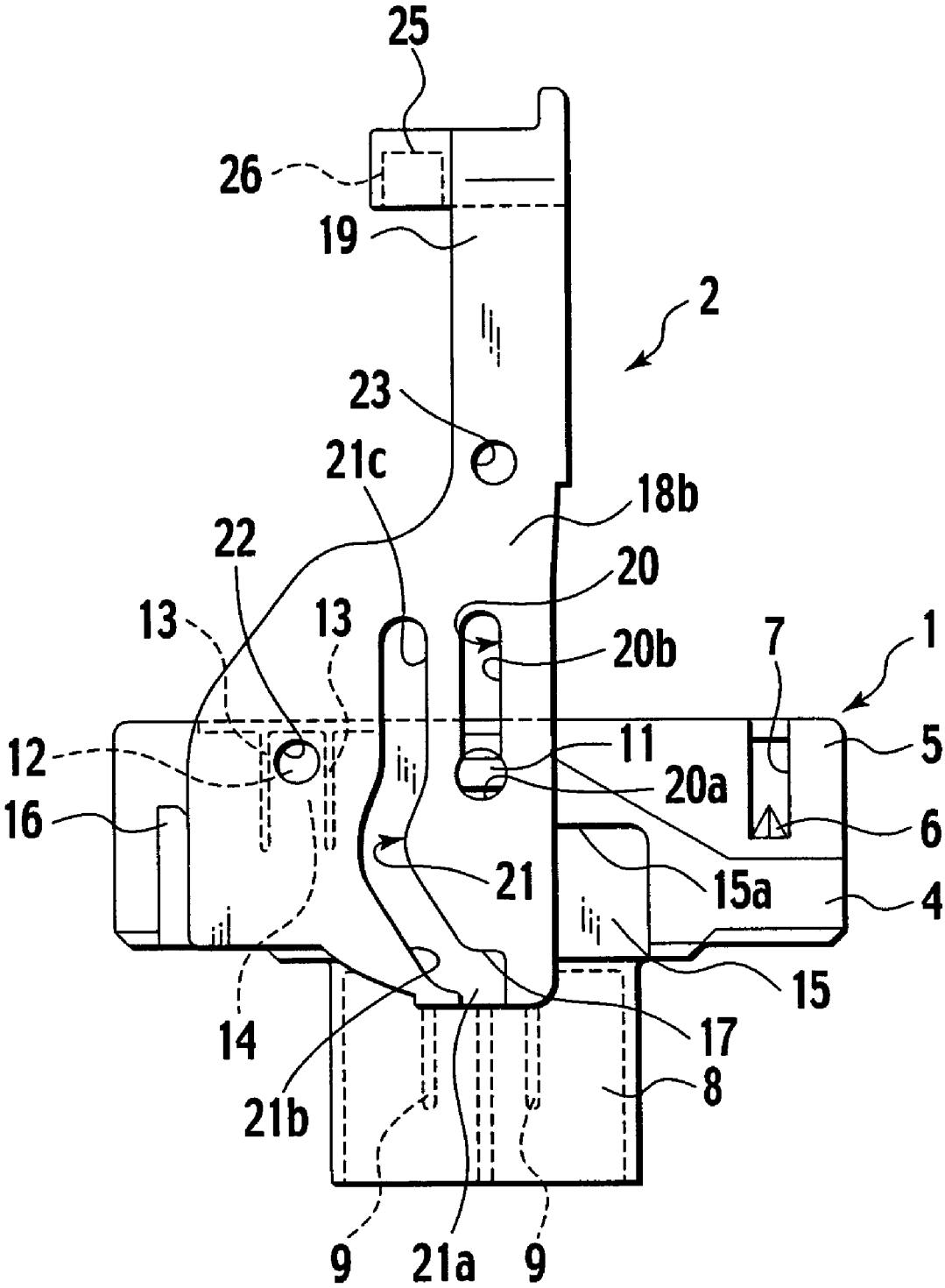
FIG. 18 shows the one embodiment of the present invention, and is a back view showing the one connector housing to which the lever is attached, in the state where the lever is located at the rotation start position.
Figure 19A:
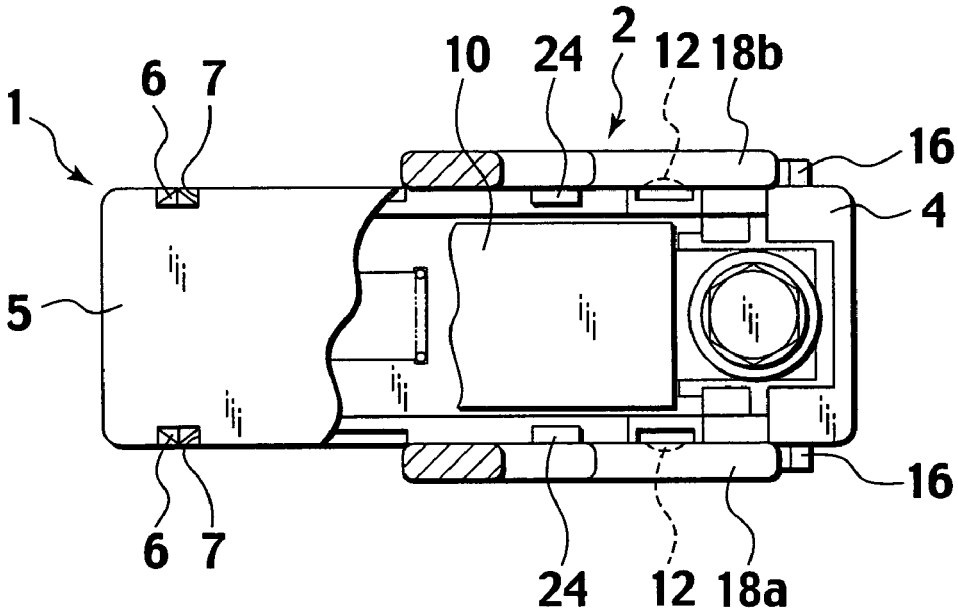
FIGS. 19A and 19B show the one embodiment of the present invention.
Figure 19B:
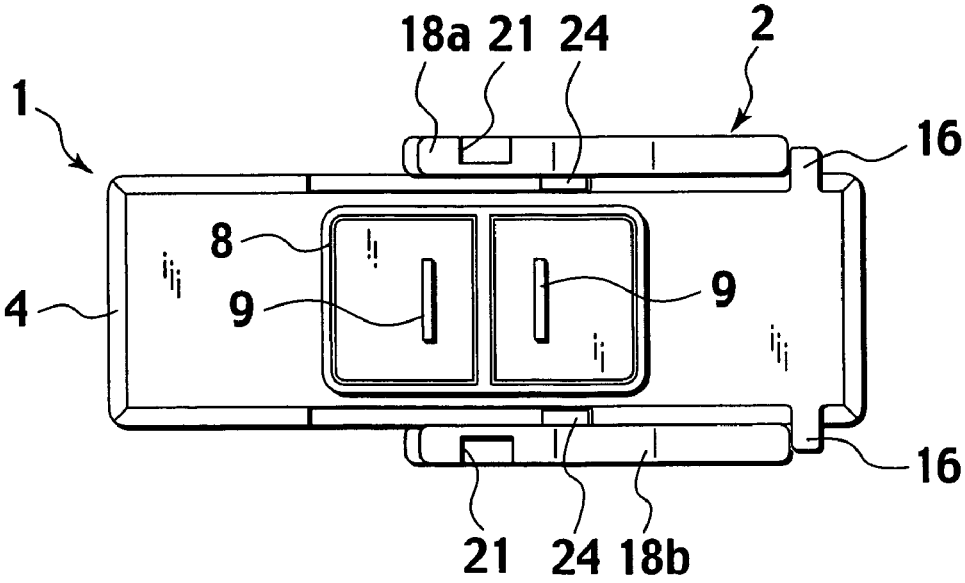
Figure 20:
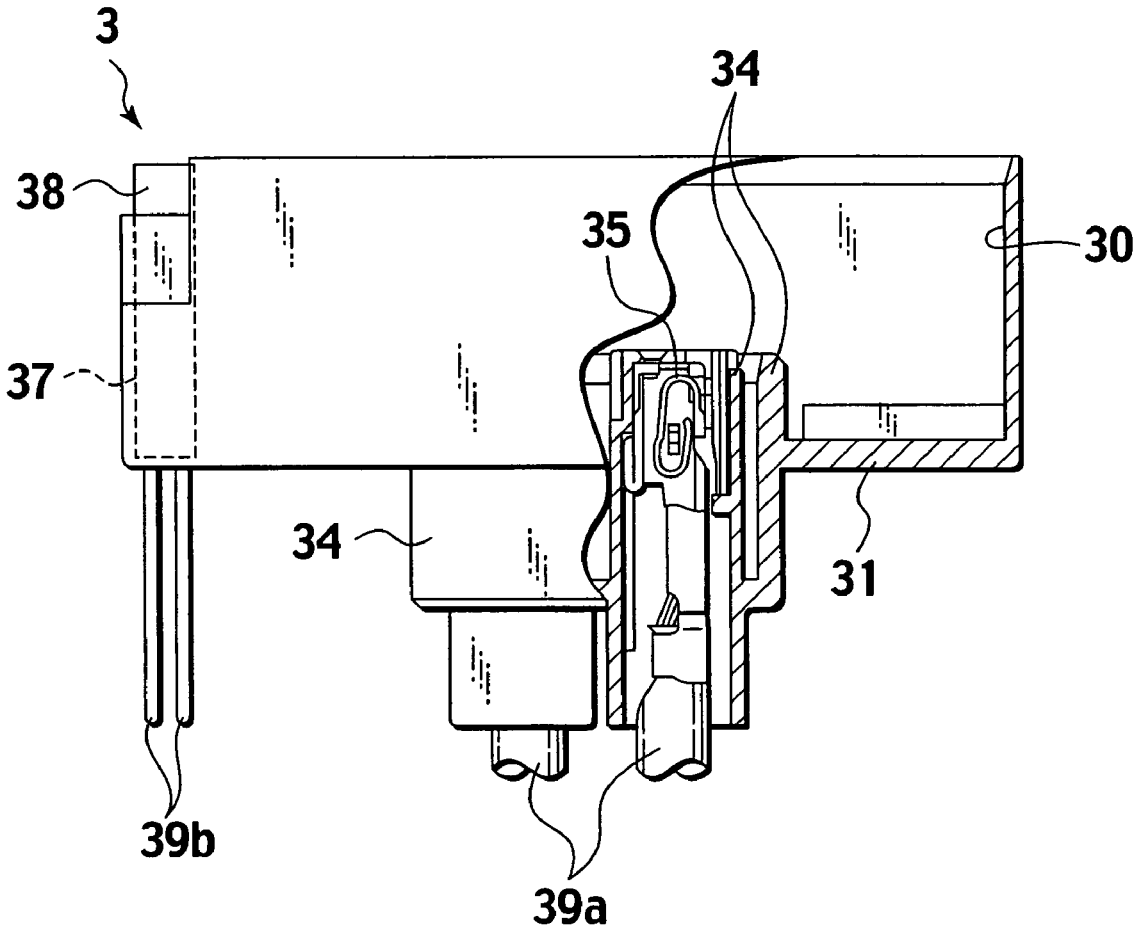
FIG. 20 shows the one embodiment of the present invention, and is a partially cutaway plan view of the other connector housing.
Figure 21A:
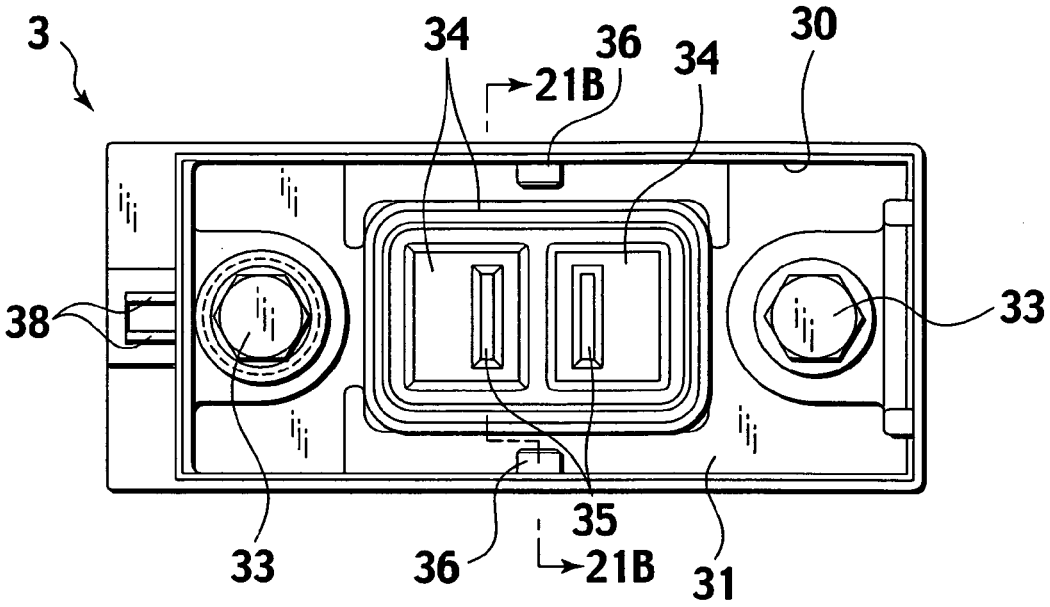
FIGS. 21A and 21B show the one embodiment of the present invention.
Figure 21B:
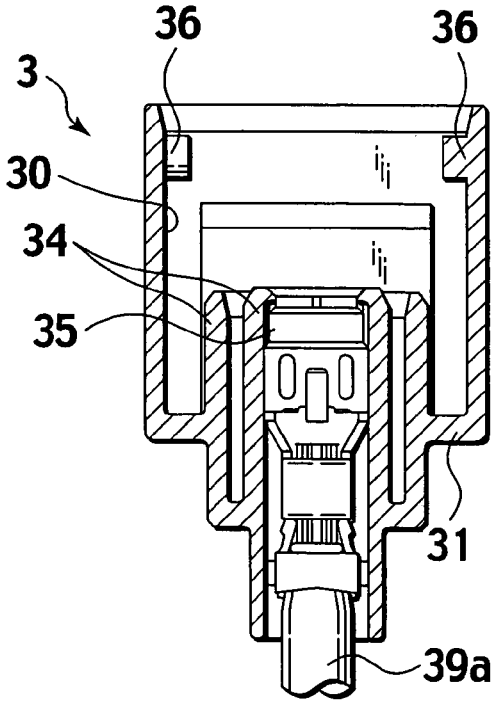

FIGS. 14A to 30C show a lever fitting-type power supply circuit breaker of the one embodiment of the present invention. FIG. 14A is an exploded front view of one connector housing. FIG. 14B is an exploded side view of the one connector housing. FIG. 15 is a perspective view of a lever. FIG. 16A is a side view of the lever. FIG. 16B is a cross-sectional view along a line 16B—16B in FIG. 16A. FIG. 17 is a front view showing the one connector housing to which the lever is attached, in a state where the lever is located at an operation start position. FIG. 18 is a back view showing the one connector housing to which the lever is attached, in the state where the lever is located at the operation start position. FIG. 19A is a partially cutaway plan view of the one connector housing to which the lever is attached. FIG. 19B is a bottom view of the one connector housing to which the lever is attached. FIG. 20 is a partially cutaway front view of the other connector housing. FIG. 21A is a plan view of the other connector housing. FIG. 21B is a cross-sectional view along a line 21B—21B in FIG. 21A.

As shown in FIGS. 23 to 28 and 1A to 5, a lever fitting-type power supply circuit breaker 1A for a high-voltage/large-current circuit includes one connector housing 1 made of synthetic resin, a lever 2 made of synthetic resin, to which the one connector housing 1 is attached, and the other connector housing 3 made of synthetic resin, to which the one connector housing 1 is attached by an operation of the lever 2.

As shown in FIGS. 14A, 14B and 17 to 19B, the one connector housing 1 includes a housing body 4, and a cover 5 attached to the housing body 4 so as to close an upper portion of the housing body 4. The cover 5 is attached to the housing body 4 in a manner that a pair of triangular protrusions (protruding portions) 6 and 6 of the housing body 4 are inserted into engaging holes 7 of the cover 5. Each triangular protrusion 6 is provided such that a lower side thereof becomes a surface orthogonal to a surface of the housing body 4, and that both of upper sides thereof become slant surfaces gradually rising from the surface of the housing body 4. Thus, the cover 5 is made attachable to the housing body 4 in two directions, which are: from above the housing body 4 as shown by a solid line in FIG. 14A, and from a side of the housing body 5 as shown by a virtual line in FIG. 14A. Hence, in the case where the lever fitting-type power supply circuit breaker 1A is installed in a narrow space, it is possible to easily attach and detach the cover 5.

Figure 1A:
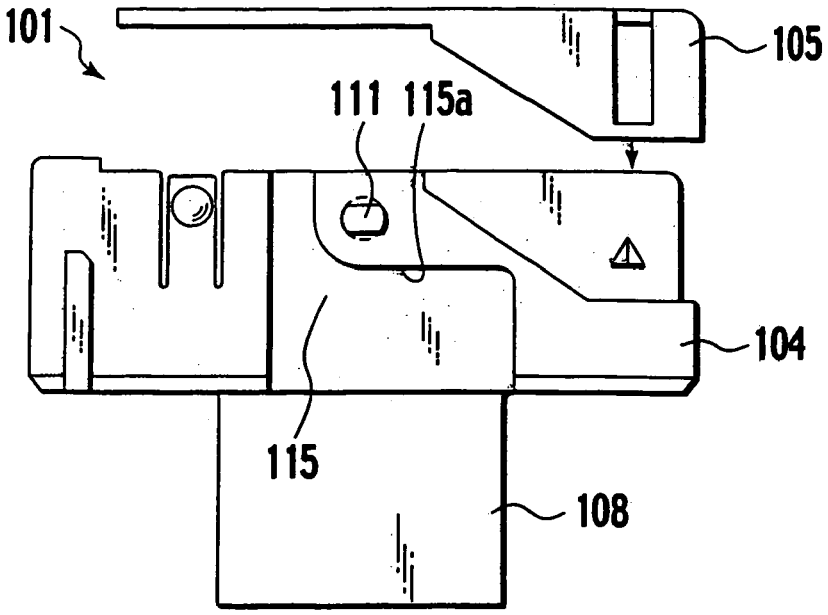
FIG.1A PRIOR ART
FIGS. 1A and 1B show a conventional example.
Figure 1B:
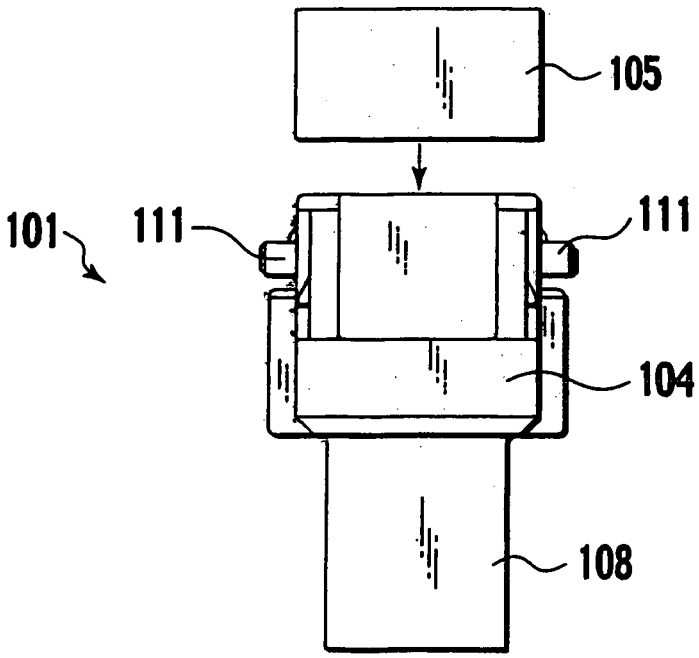
FIG.1B PRIOR ART
Figure 2:
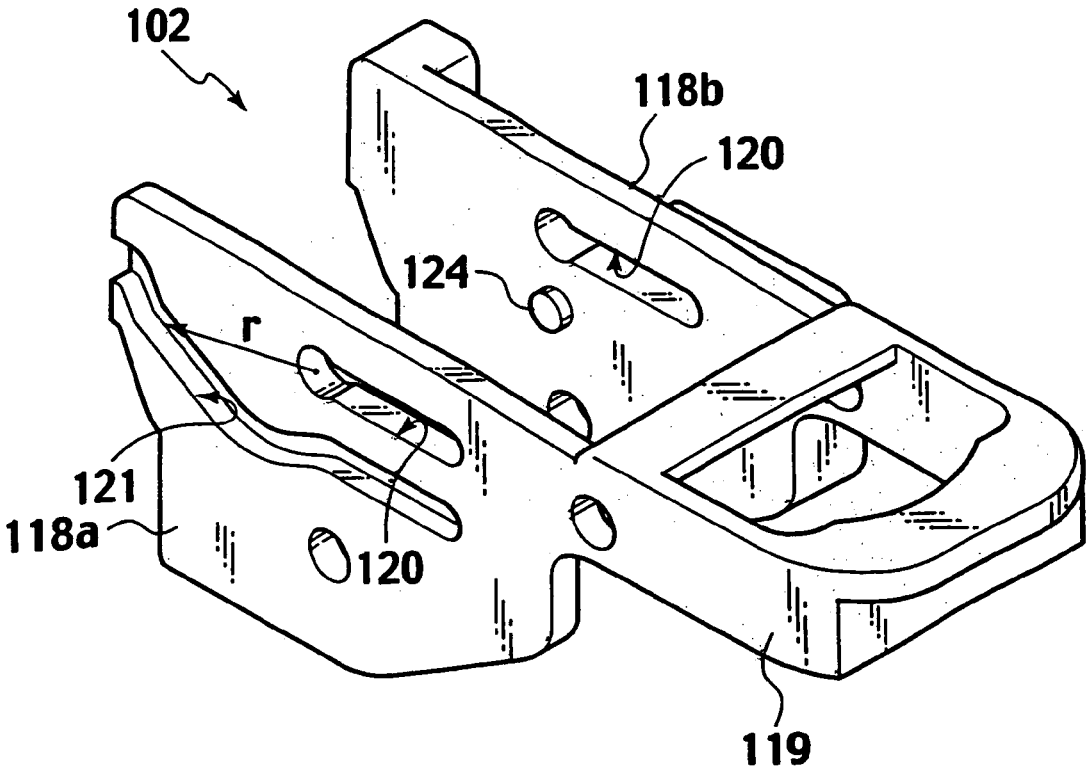
PRIOR ART FIG.2
FIG. 2 shows the conventional example, and is a perspective view of a lever.
Figure 3A:
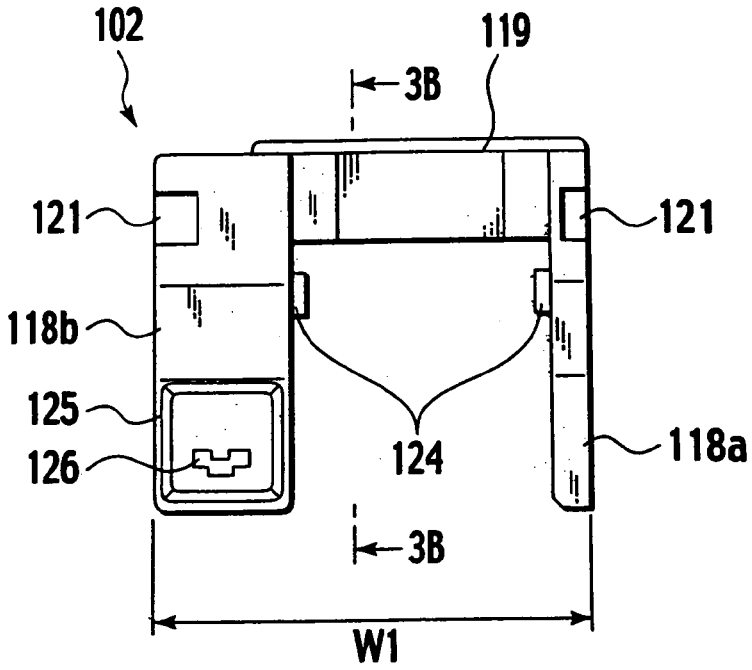
FIG.3A PRIOR ART
FIGS. 3A and 3B show the conventional example.
Figure 3B:
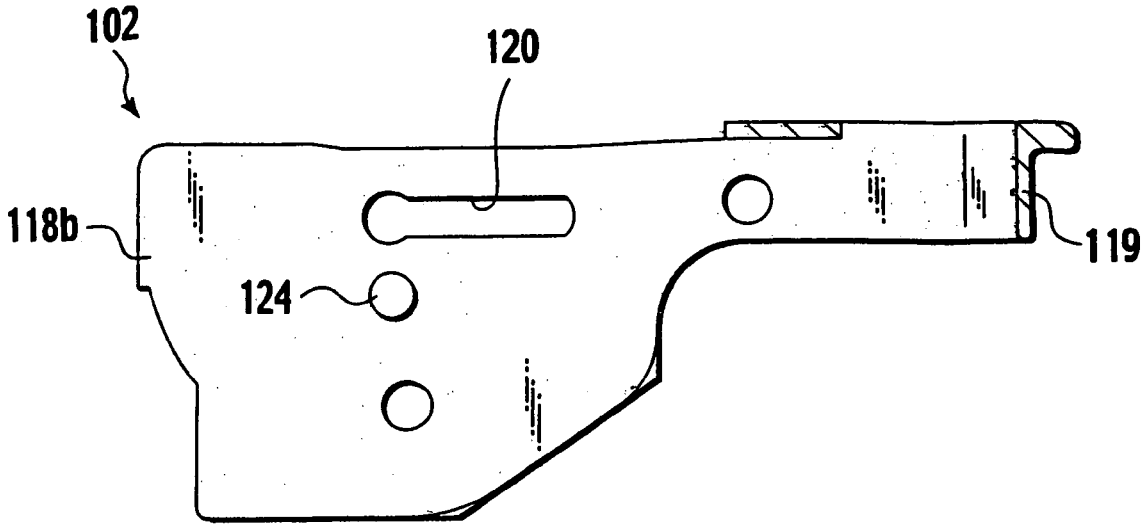
FIG.3B PRIOR ART
Figure 4:
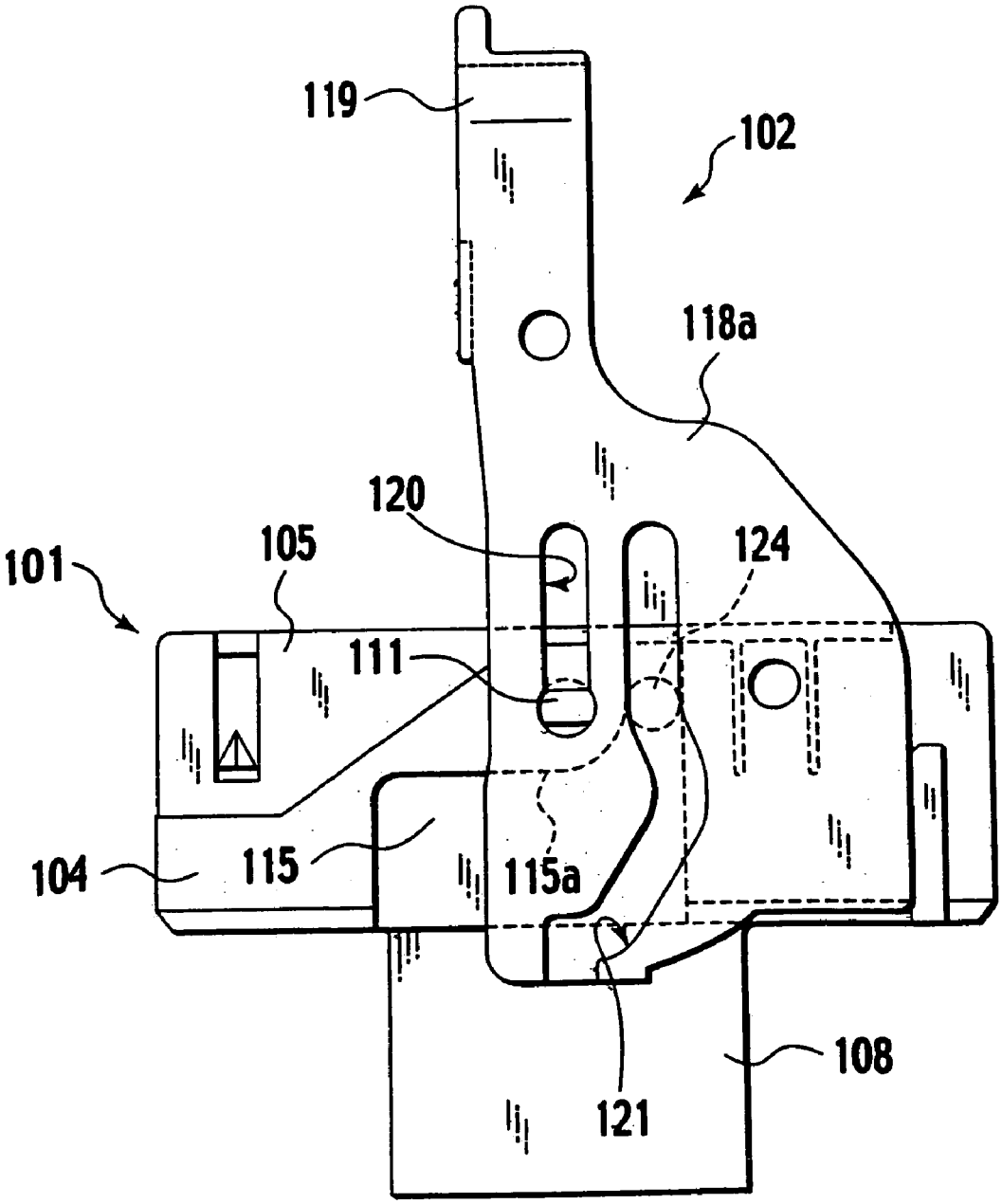
PRIOR ART FIG.4
FIG. 4 shows the conventional example, and is a front view showing the one connector housing to which the lever is attached, in a state where the lever is located at an operation start position.
Figure 5:
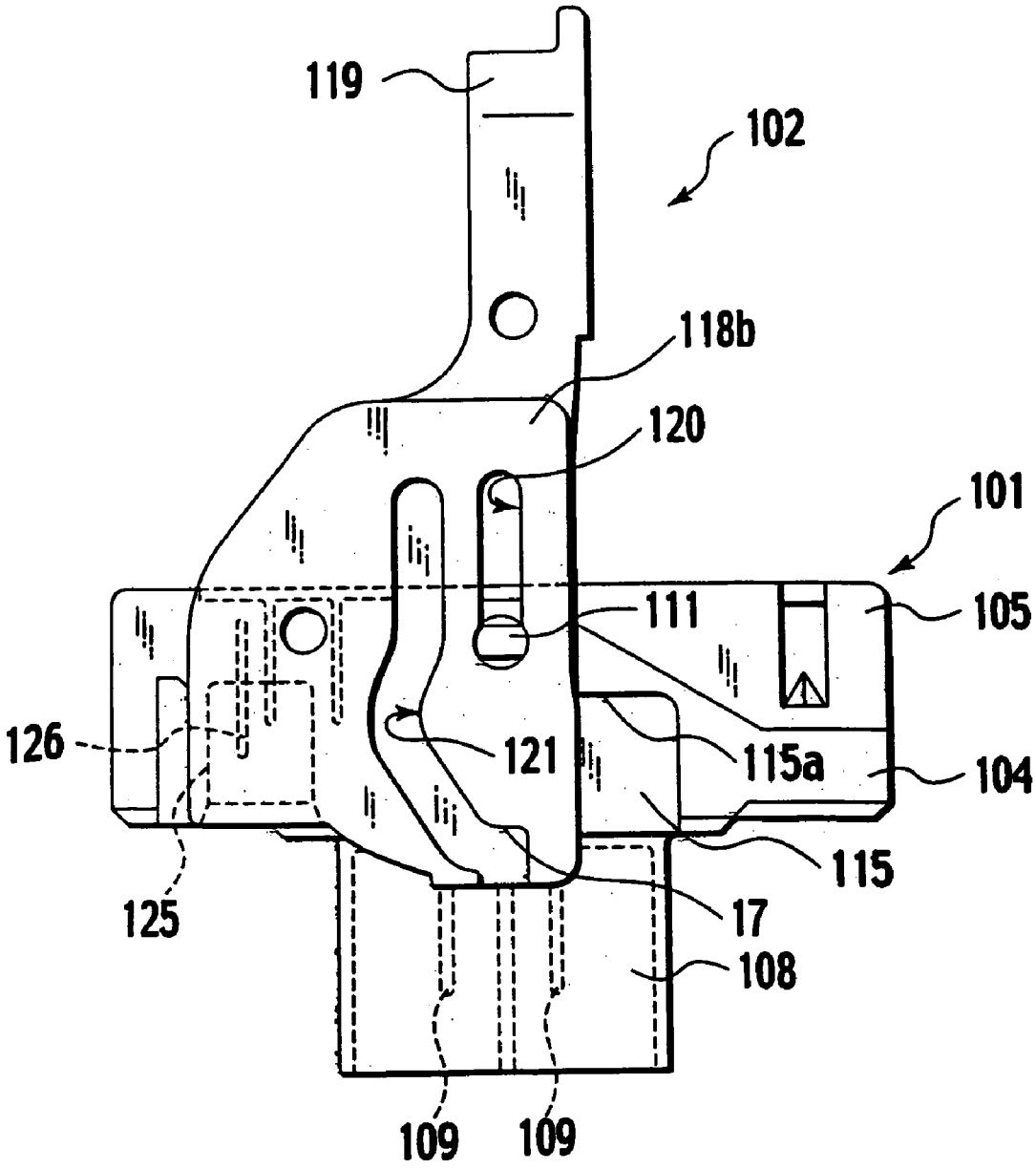
PRIOR ART FIG.5
FIG. 5 shows the conventional example, and is a back view of the one connector housing to which the lever is attached, in a state where the lever is located at a rotation start position.
Figure 6A:
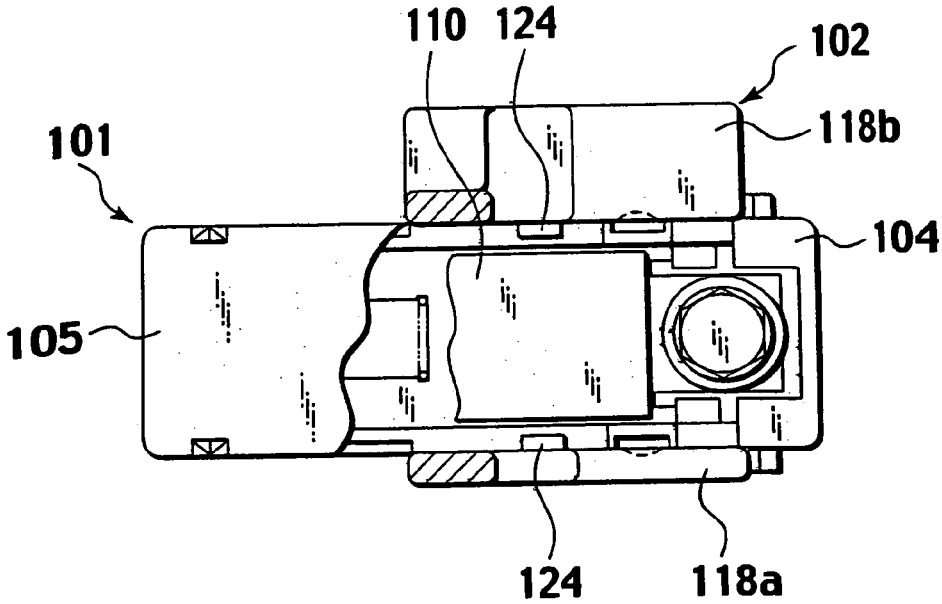
FIG.6A PRIOR ART
FIGS. 6A and 6B show the conventional example.
Figure 6B:
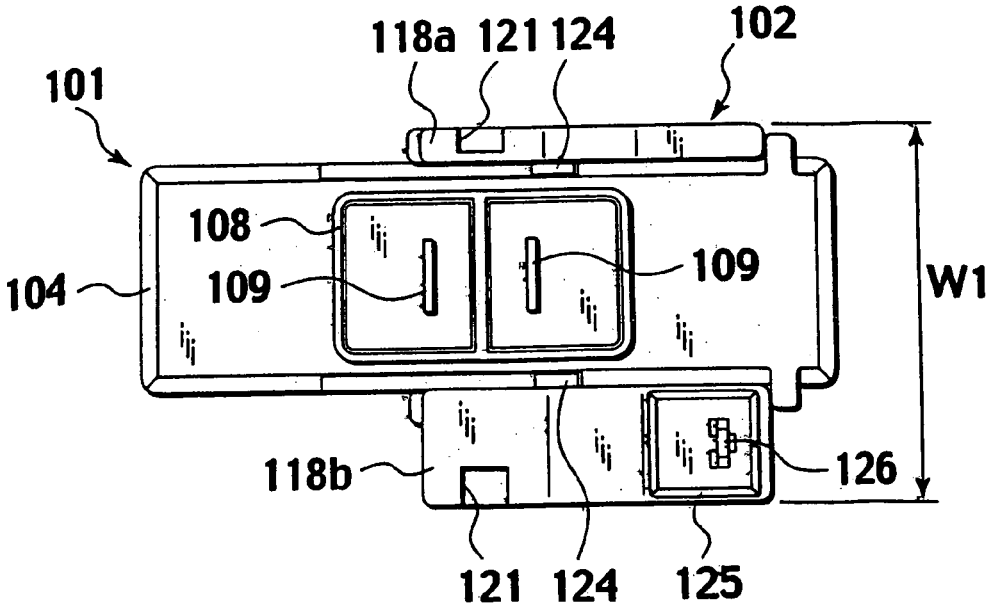
FIG.6B PRIOR ART
Figure 7:
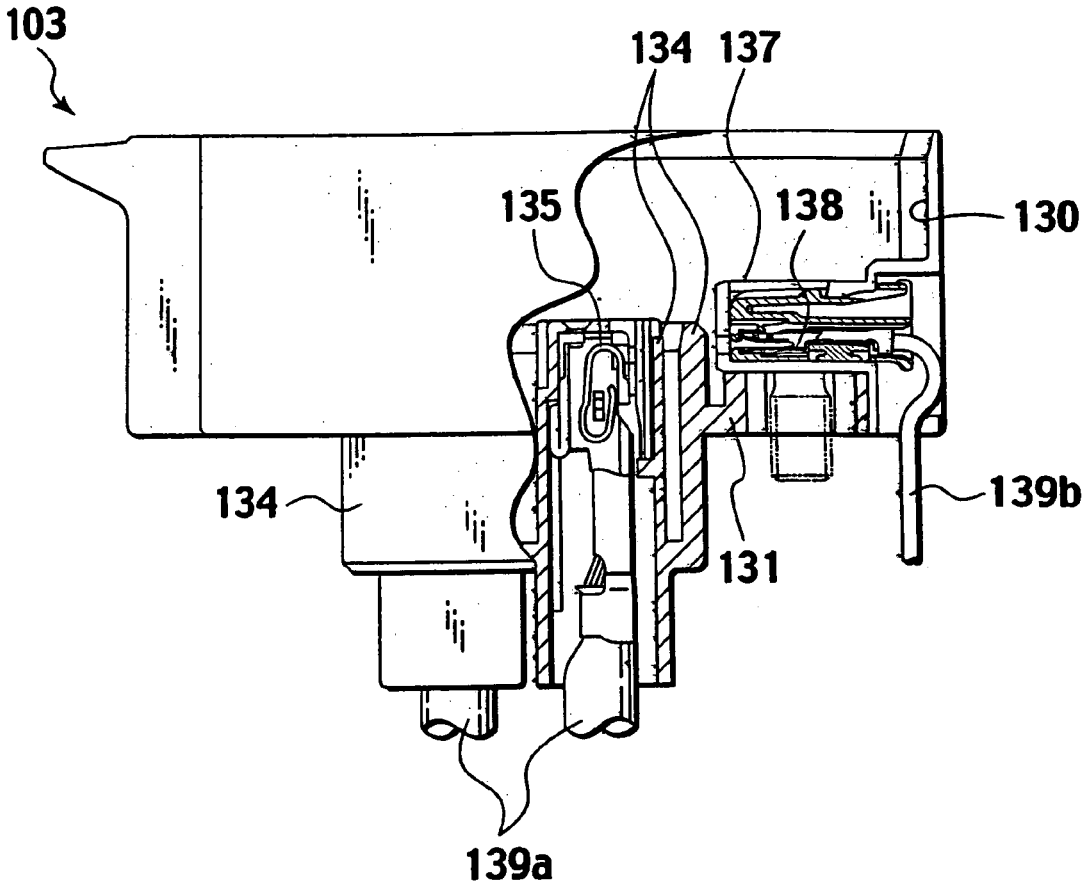
FIG.7 PRIOR ART
FIG. 7 shows the conventional example, and is a partially cutaway front view of the other connector housing.
Figure 8A:
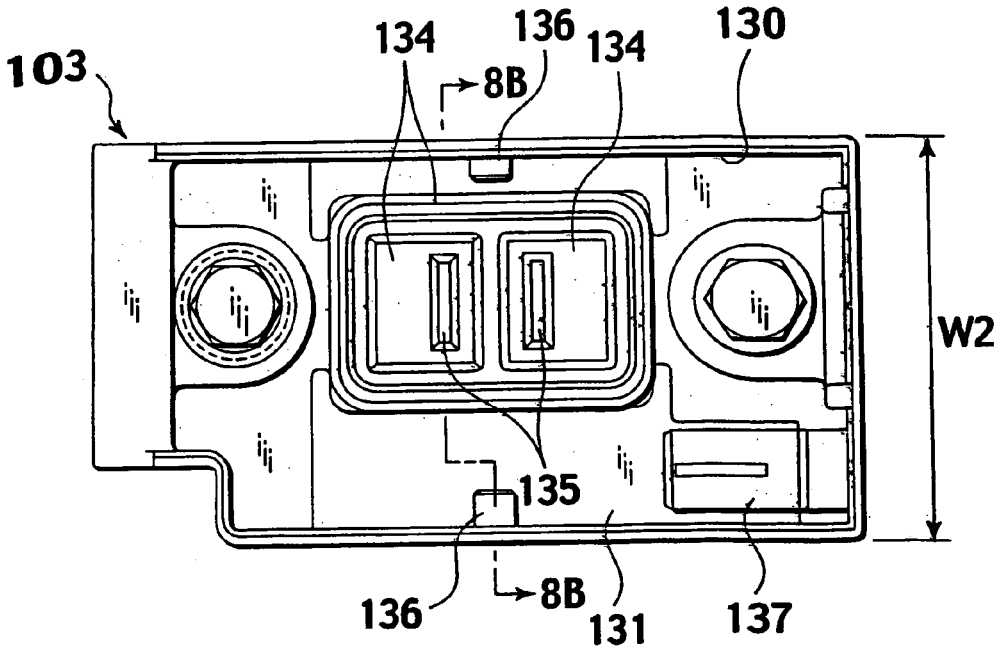
FIG.8A PRIOR ART
FIGS. 8A and 8B show the conventional example.
Figure 8B:
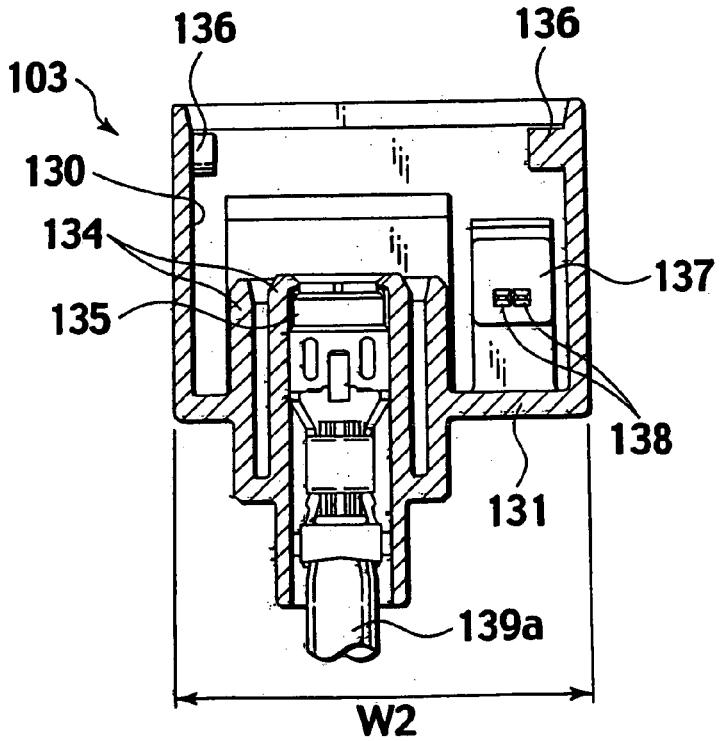
FIG.8B PRIOR ART
Figure 9:
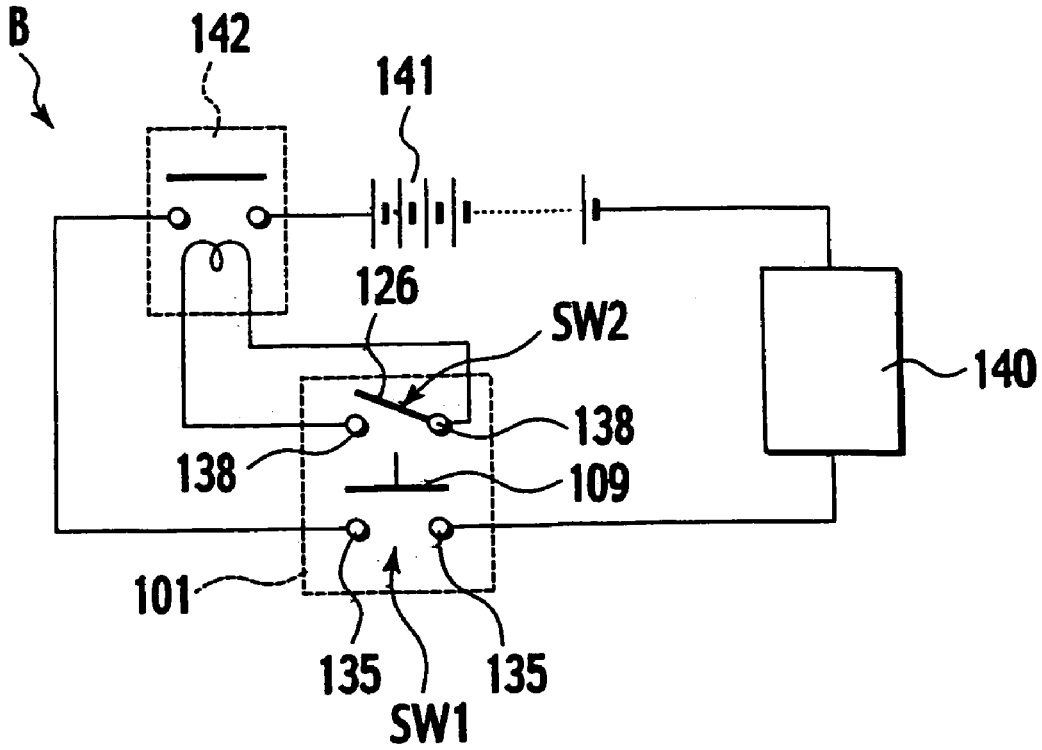
FIG.9 PRIOR ART
FIG. 9 shows the conventional example, and is a circuit diagram of a power supply circuit.
Figure 10:
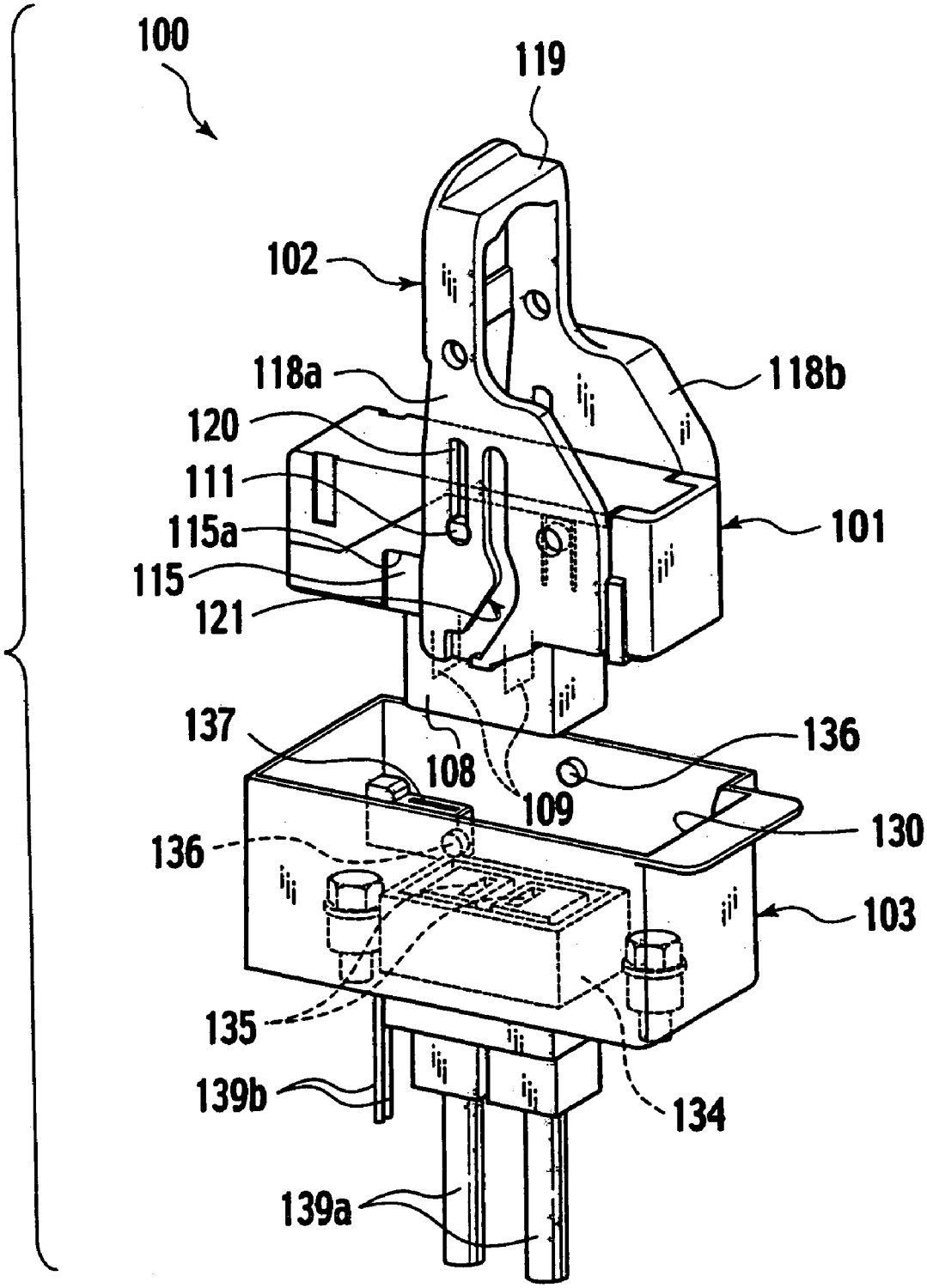
FIG.10 PRIOR ART
FIG. 10 shows the conventional example, and is a perspective view showing a state before the one connector housing is temporarily fitted to the other connector housing.
Figure 11:
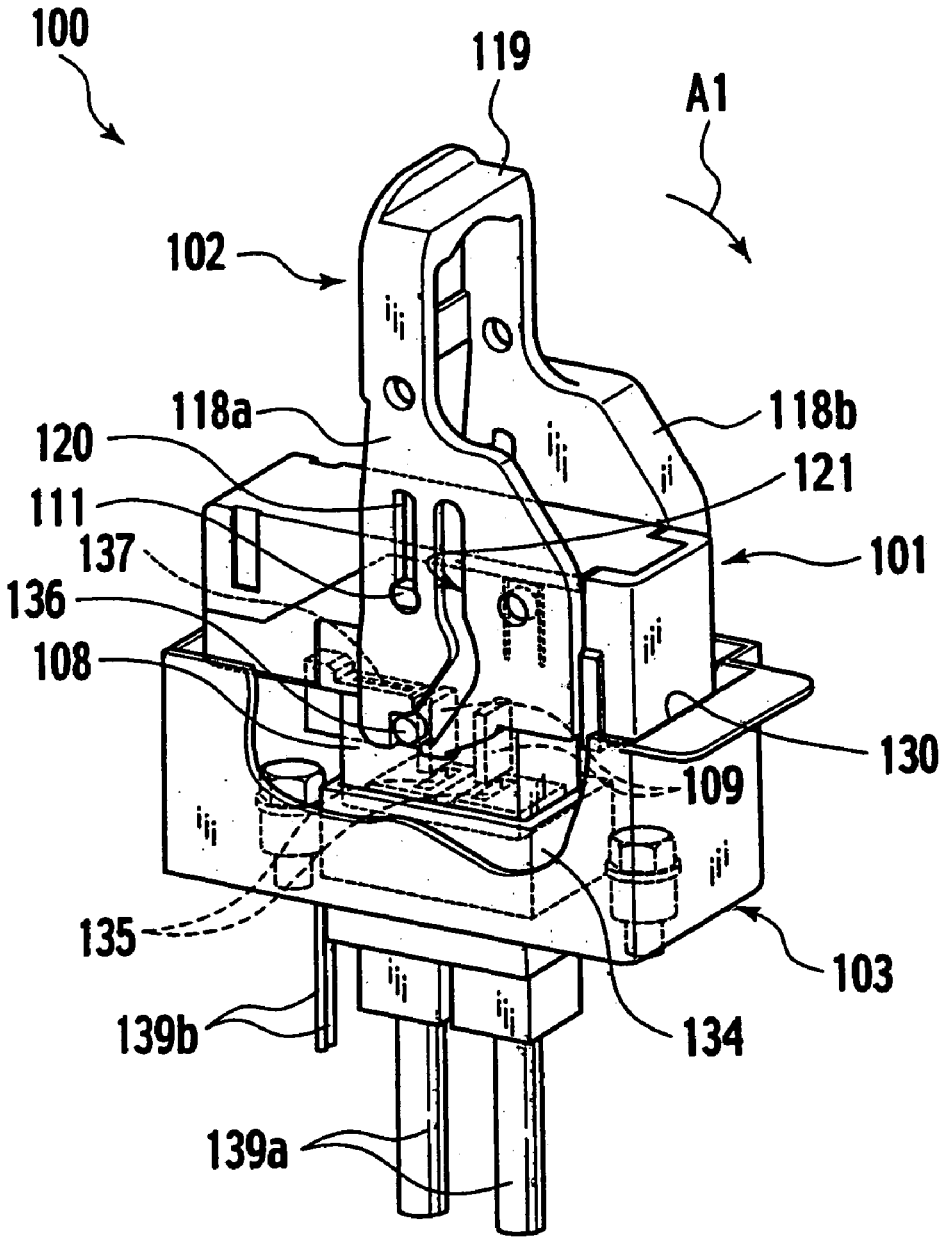
FIG.11 PRIOR ART
FIG. 11 shows the conventional example, and is a perspective view showing a state where the one connector housing is temporarily fitted to the other connector housing and the lever is located at the operation start position.
Figure 12:
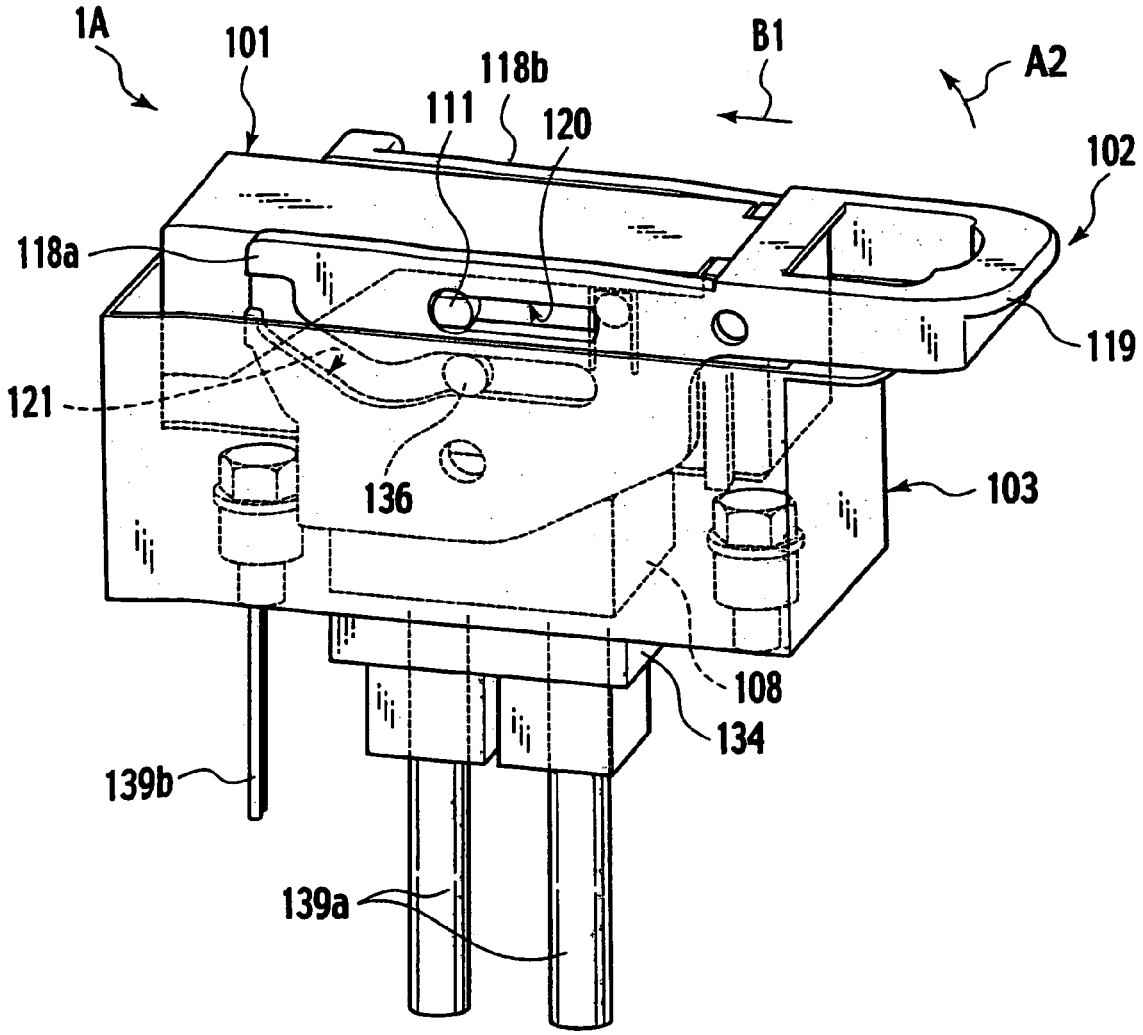
FIG.12 PRIOR ART
FIG. 12 shows the conventional example, and is a perspective view showing a state where one connector housing is fitted to the other connector housing and the lever is located at a rotation completion position.
Figure 13:
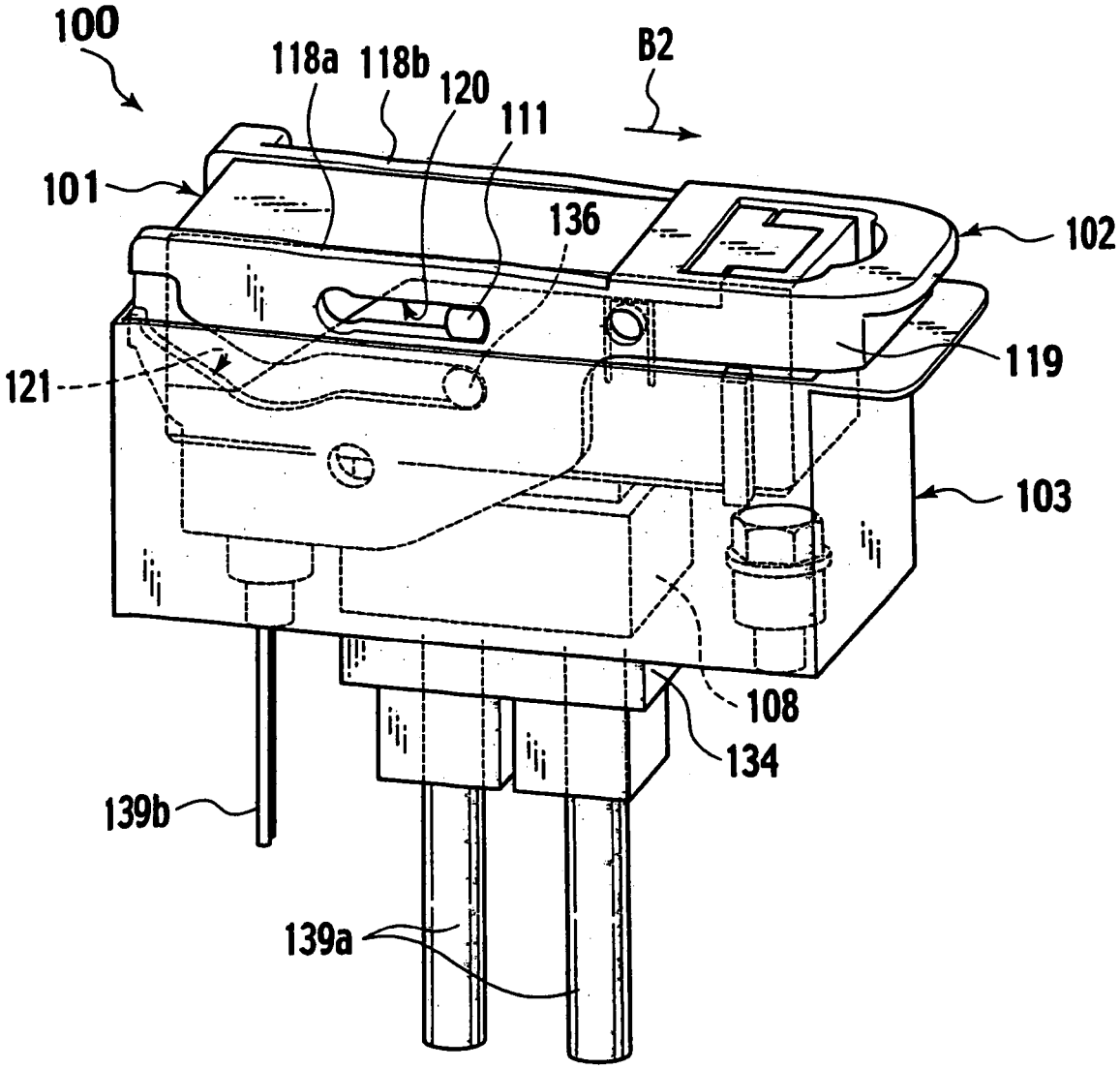
FIG.13 PRIOR ART
FIG. 13 shows the conventional example, and is a perspective view showing a state where the one connector housing is fitted to the other connector housing and the lever is located at an operation completion position.

A terminal hood portion 8 is provided under the housing body 4, and a pair of power male terminals (terminals for power) 9 and 9 shown in FIGS. 18 and 19B are provided in the terminal hood portion 8 in a state of being protruded downward. The pair of power male terminals 9 and 9 are electrically connected to each other through a fuse 10 which is shown in FIGS. 19A and 4 and is housed in the housing body 4.

A pair of guide pins 11 and 11 are protruded from outer walls of the housing body 4, and each of the guide pins 11 and 11 has a substantially ellipsoidal shape obtained by cutting upper and lower ends of a circular cylinder shape. Specifically, long-width portions and short-width portions are composed. Then, guide grooves 20 of the lever 2, which are described later, are individually engaged with the pair of guide pins 11 and 11.

Moreover, a pair of substantially hemispherical engaging protrusions (convex portions) 12 and 12 are protruded from the outer walls of the housing body 4, and each of the engaging protrusions 12 and 12 is provided on a flexible arm portion 14 formed between a pair of slits 13 and 13 of the outer wall of the housing body 4. The pair of engaging protrusions 12 and 12 are ones which hold the lever 2 at a predetermined position by being inserted into first engaging holes 22 and second engaging holes 23 of the lever 2, which are described later. Each engaging protrusion 12 is easily displaced in an inward direction of the housing body 4 due to an elastic flexible deformation of the flexible arm portion 14. Furthermore, a pair of lever-path adjusting guide grooves 15 and 15 are provided on the outer walls of the housing body 4. One of step side faces (denoted by reference numeral 15*a*) forming the respective lever-path adjusting guide grooves 15 and 15 is formed of a vertical step side face extended in a vertical direction, a horizontal step side face extended in a horizontal direction, and a circular arc step side face connecting these side faces in a circular arc shape. Then, with the pair of lever-path adjusting guide grooves 15 and 15, a pair of lever-path adjusting guide pins 24 and 24 of the other connector housing 3, which are described later, are engaged. The pair of lever-path adjusting guide pins 24 and 24 are slid along the step side faces 15*a* of the lever-path adjusting guide grooves 15.

Moreover, a pair of lever rotation stopper portions 16 and 16 are protruded from the housing body 4. The pair of lever rotation stopper portions 16 and 16 regulate rotation of the lever 2 such that the lever 2 is rotatable between an operation start position of FIGS. 23 and 24, where the lever 2 is erected vertically to the one connector housing 1, and a rotation completion position of FIG. 27, where the lever 2 is set parallel to the one connector housing 1.

Figure 27:
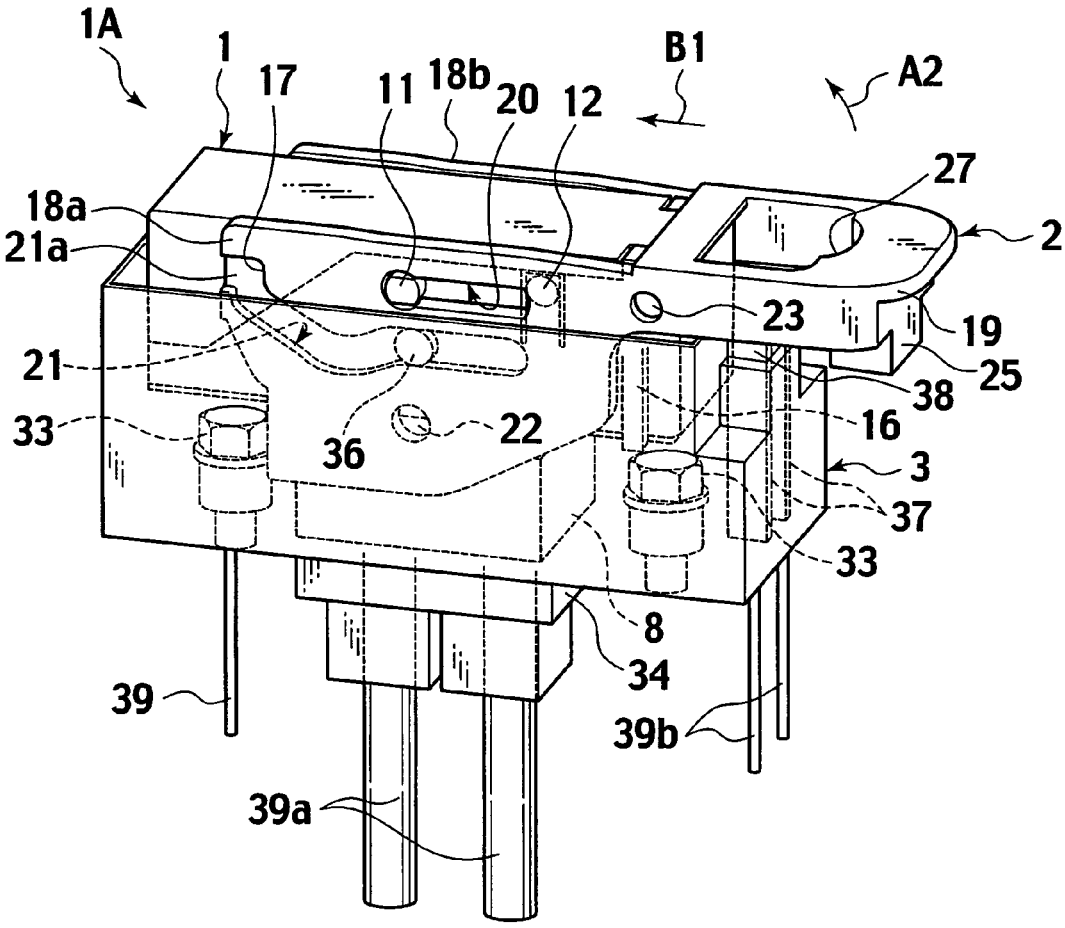
FIG. 27 shows the one embodiment of the present invention, and is a perspective view showing the connector-fitting position in the process of attaching the one connector housing to the other connector housing in a state where the lever is located at a rotation completion position.
Figure 28:
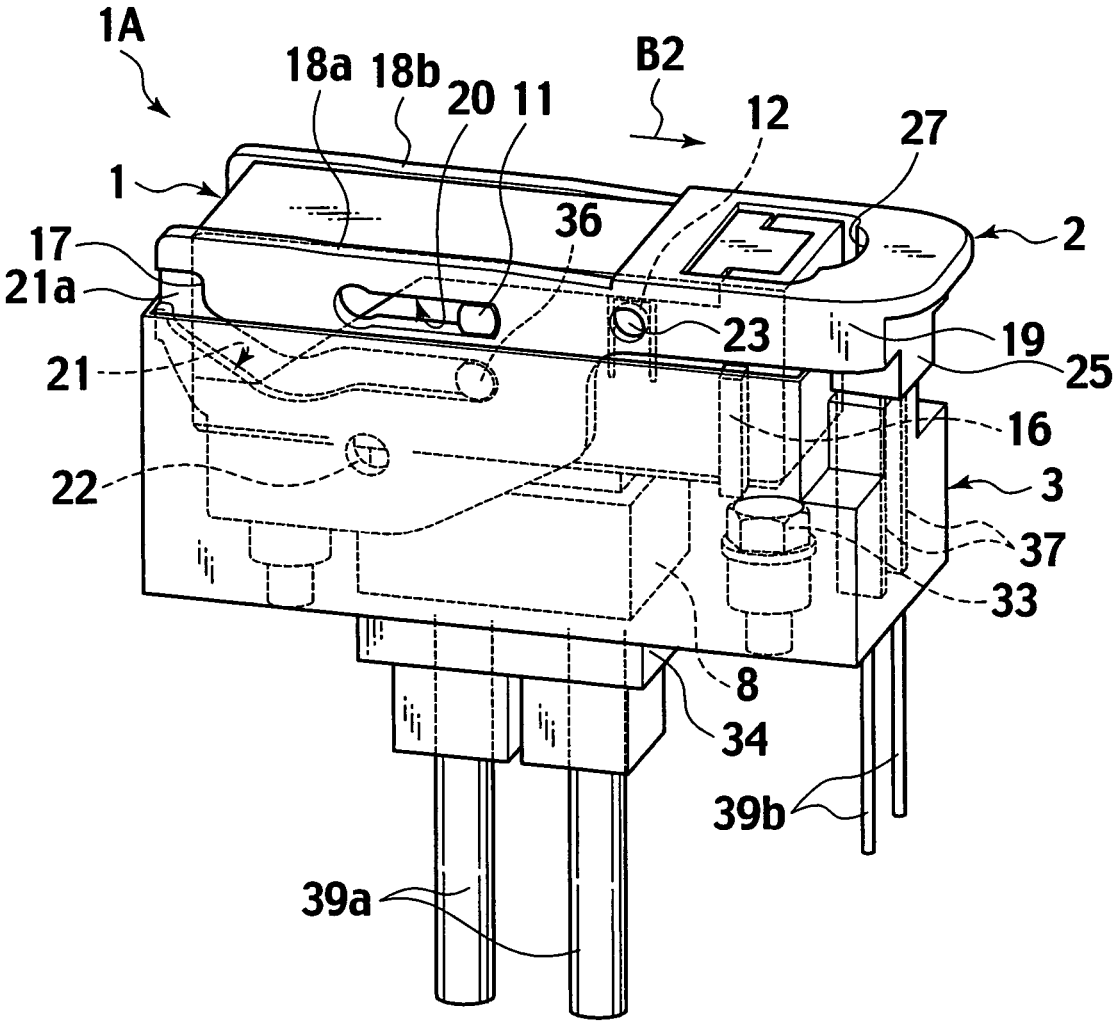
FIG. 28 shows the one embodiment of the present invention, and is a perspective view showing a state where the attachment of the one connector housing to the other connector housing is completed, that is, the connector fitting position in a state where the lever is located at an operation completion position.

As shown in FIGS. 15 to 19B, the lever 2 includes a pair of arm plate portions 18*a* and 18*b* arranged in parallel at an interval, and an operating portion 19 coupling the pair of arm plate portions 18*a* and 18*b* to each other. In the pair of arm plate portions 18*a* and 18*b*, the guide grooves 20 extended in the horizontal direction are provided at positions symmetric to each other. Into the respective guide grooves 20, the pair of guide pins 11 and 11 of the one connector housing 1 are individually inserted. Each of the guide grooves 20 is composed of a circular arc portion 20*a* on one end side, and of a linear straight portion 20*b* communicating therewith. A diameter of the circular arc portion 20*a* is somewhat larger than a diameter of circular arc portions (long-width portions) of the guide pin 11, and a width of the straight portion 20*b* is somewhat larger than a width of the cut portions (short-width portions) of the guide pin 11. The guide grooves 20 are provided in such a way. Then, in the lever 2, in rotation positions other than the rotation completion position shown in FIG. 27, the guide pins 11 are enabled to be arranged only in the circular arc portions 20*a*, and a rotational movement thereof between the operation start position of FIGS. 23 and 24 and the rotation completion position of FIG. 27 is allowed. In the rotation completion position of FIG. 27, the guide pins 11 are allowed to slide from the circular arc portions 20*a* of the guide grooves 20 to the straight portions 20*b*, and a linear sliding movement thereof between the rotation completion position of FIG. 27 and the operation completion position of FIG. 28 is allowed. As described above, the lever 2 is provided so as to rotationally move and linearly move with respect to the one connector housing 1.

Moreover, in the pair of arm plate portions 18*a* and 18*b*, cam grooves 21 are provided at positions symmetric to each other. Into the pair of cam grooves 21 and 21, cam pins 36 of the other connector housing 3, which are described later, are inserted when the one connector housing 1 is attached to the other connector housing 3. The respective cam grooves 21 have one ends serving as opening portions open to end surfaces of the arm plate portions 18*a* and 18*b*. Each of the cam grooves 21 is composed of a bent portion 21*b* varied in a direction where a distance r from the circular arc portion 20*a* of the guide groove 20 is made gradually closer as the bent portion 21*b* goes toward a deep recess thereof from the opening portion 21*a*, and of a straight portion 21*c* arranged in parallel to the straight portion 20*b* of the guide groove 20.

Figure 23:
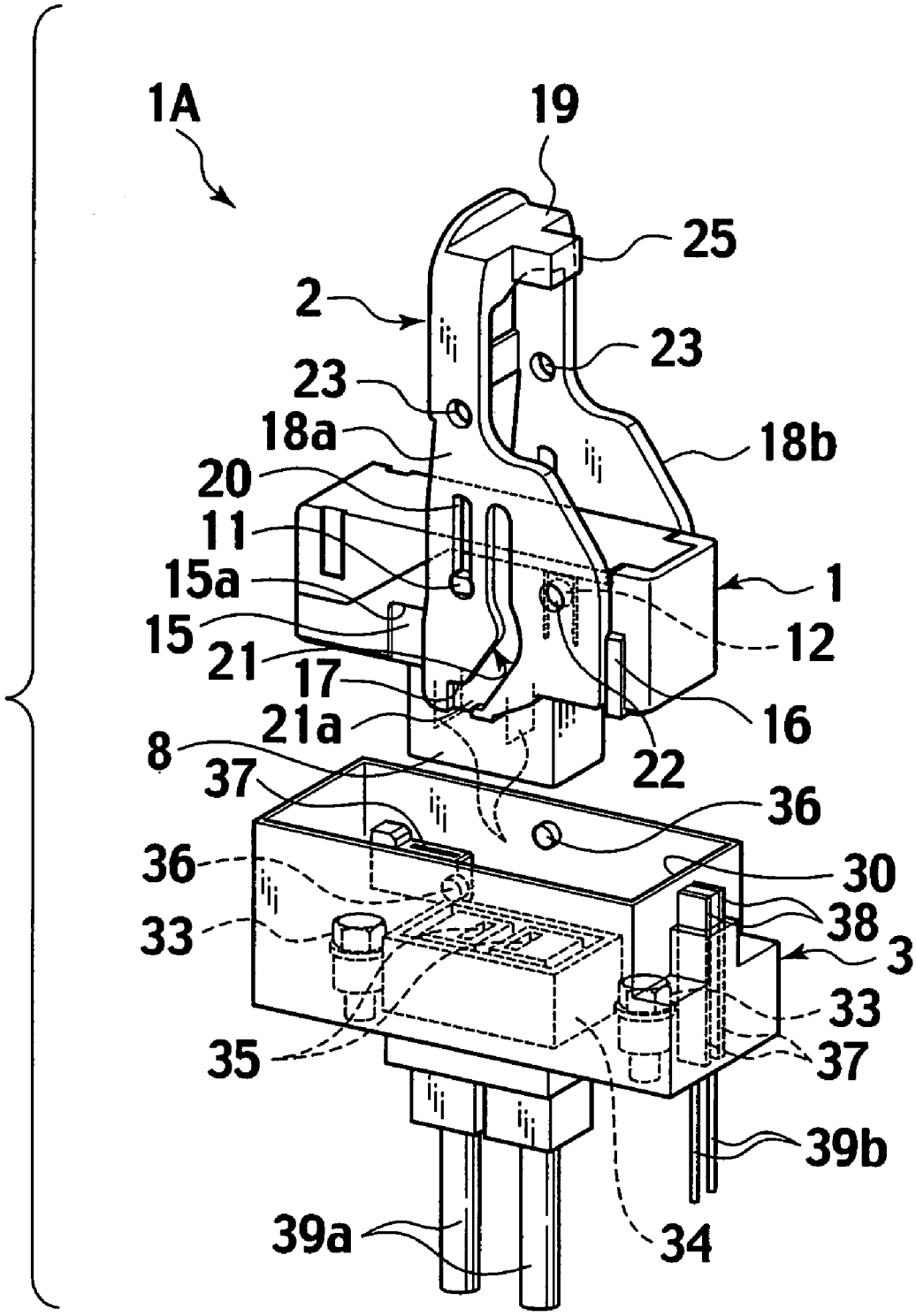
FIG. 23 shows the one embodiment of the present invention, and is a perspective view showing a state before the one connector housing is temporarily fitted to the other connector housing.
Figure 24:
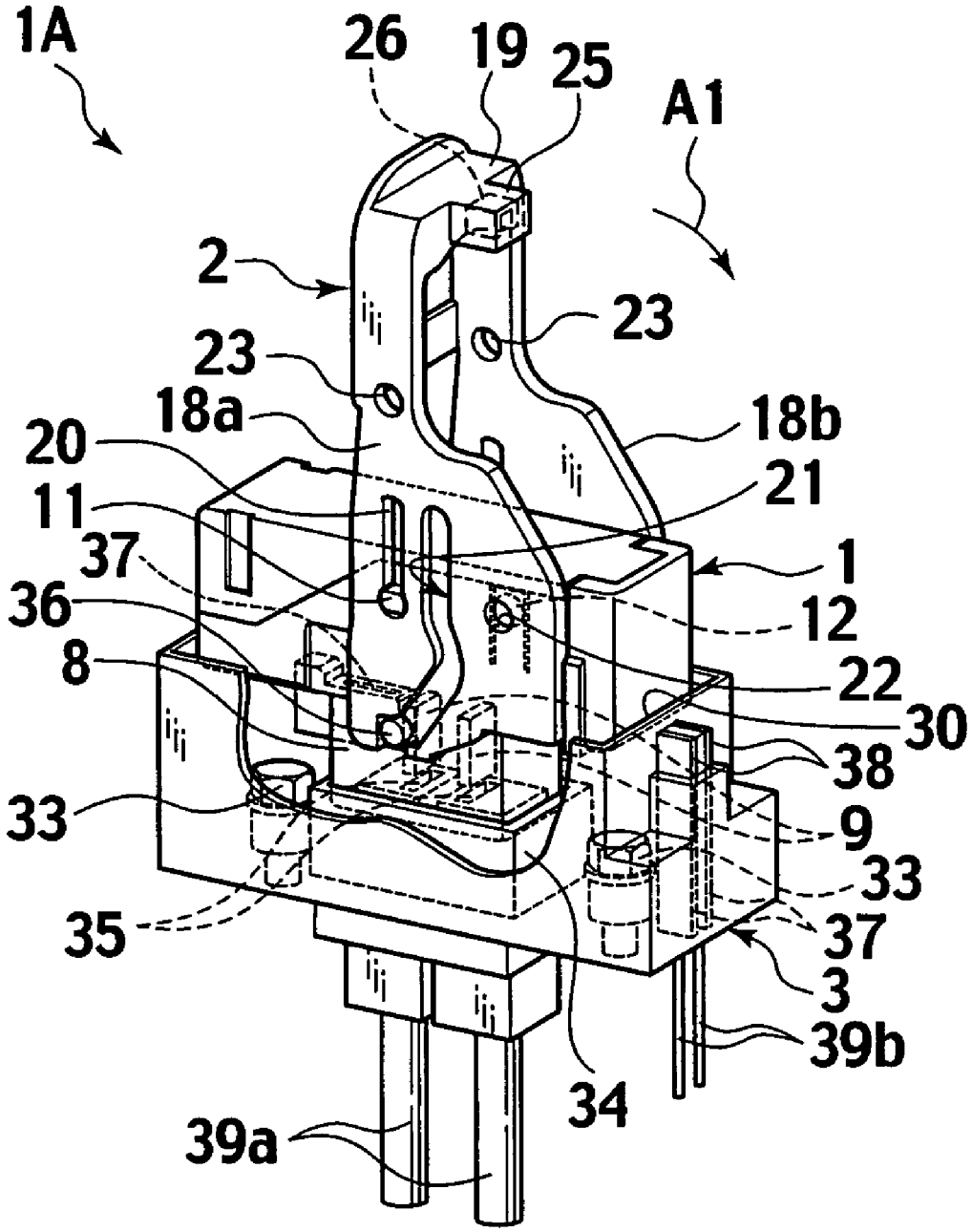
FIG. 24 shows the one embodiment of the present invention, and is a perspective view showing a temporal connector-fitting position in a process of attaching the one connector housing to the other connector housing in a state where the lever is located at an operation start position.
Figure 25:
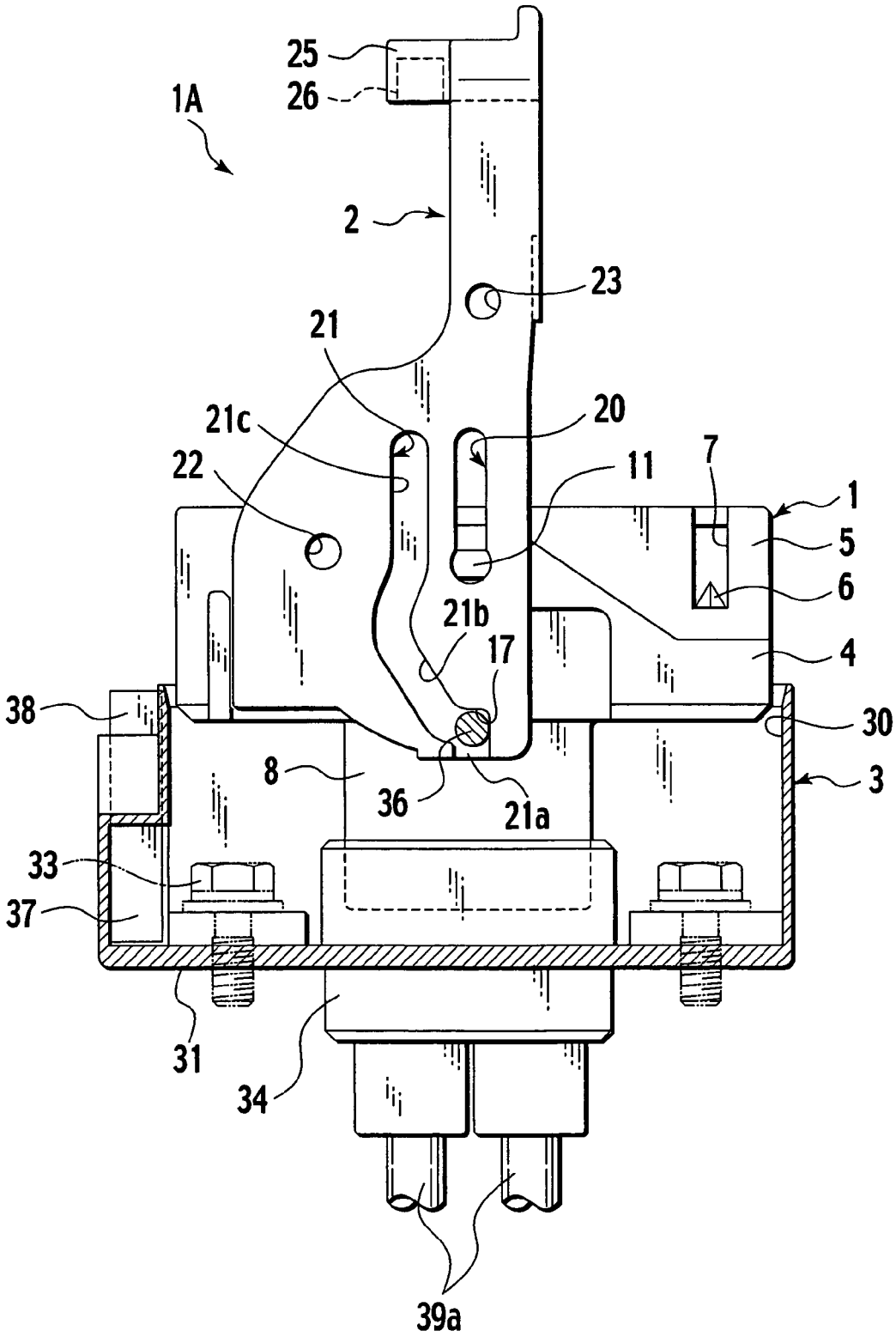
FIG. 25 shows the one embodiment of the present invention, and is a partially cutaway front view showing the temporal connector-fitting position in the process of attaching the one connector housing to the other connector housing in the state where the lever is located at the operation start position.

Furthermore, in the case where the lever 2 is vertically erected as shown in FIG. 23, an upper sidewall surface of the opening portion 21*a* is formed, as shown in FIGS. 24 and 25, as a sidewall stopper surface 17 of the cam groove 21, on which the cam pin 36 is made to abut, when the one connector housing 1 is inserted into the other connector housing 3 without using the lever 2 and both thereof are set at a temporal connector-fitting position. Specifically, the cam pin 36 is inhibited from being inserted more at this stage, and only by the operation of the lever 2, the cam pin will be inserted more.

Moreover, in each of the pair of arm plate portions 18*a* and 18*b*, the first engaging hole (concave portion) 22 and the second engaging hole (concave portion) 23 are individually provided at positions symmetric to the others. Each of the engaging protrusions 12 of the one connector housing 1 is inserted into the first engaging hole 22 and the second engaging hole 23. At the operation start position (rotation start position) where the lever 2 is erected vertically to the one connector housing 1, the engaging protrusion 12 is inserted into the first engaging hole 22, and thus a position of the lever 2 is maintained at the operation start position (rotation start position). Furthermore, at the operation completion position where the lever 2 is set parallel to the one connector housing 1, the engaging protrusion 12 is inserted into the second engaging hole 23, and thus the position of the lever 2 is maintained at the operation completion position. Note that, because the rotation completion position of the lever 2 is an operation midstream position, an engagement of the engaging protrusion 12 is not performed.

Furthermore, in inner walls of the pair of arm plate portions 18*a* and 18*b*, the pair of lever-path adjusting guide pins 24 and 24 are individually provided. The pair of lever-path adjusting guide pins 24 and 24 are engaged with the pair of lever-path adjusting guide grooves 15 and 15 of the one connector housing 1.

On a lower portion of the operating portion 19, a pin holding portion 25 is provided, and in the pin holding portion 25, a short pin 26 which is a fitting sensing terminal is held. The short pin 26 is composed of contact portions arranged in substantially parallel at an interval and a coupling short portion coupling the pair of contact portions to each other, and is formed of a conductive material which is formed into a substantially U-shape and rich in elasticity. Moreover, in the operation portion 19, a finger insertion hole 27 is provided, and a size of the finger insertion hole 27 is set at an extent where only one finger of an operator can barely be inserted thereinto.

Figure 26:
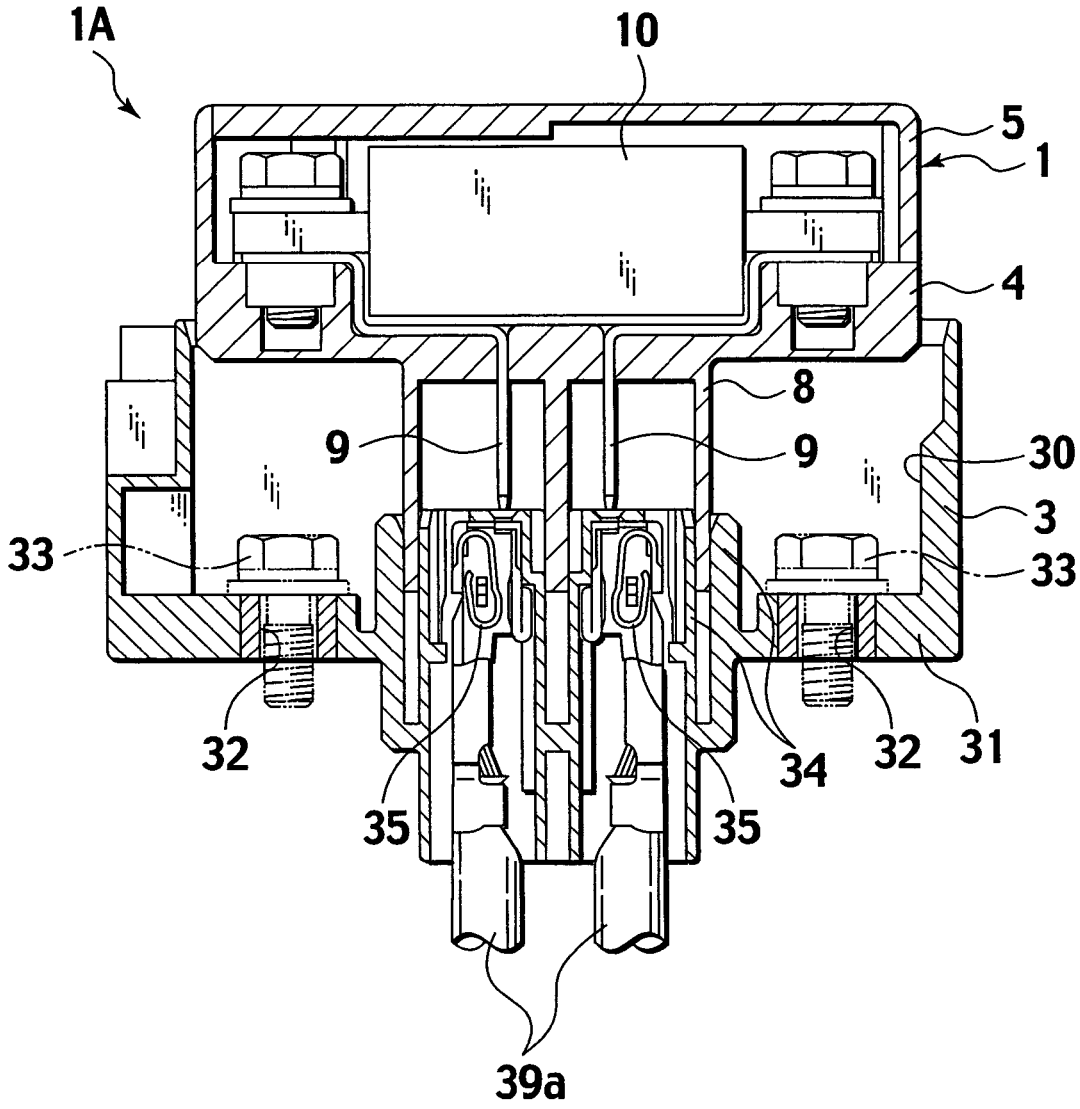
FIG. 26 shows the one embodiment of the present invention, and is a cross-sectional view showing the temporal connector-fitting position in the process of attaching the one connector housing to the other connector housing, in which the lever located at the operation start position is omitted.

As shown in FIGS. 20, 21A and 21B, the other connector housing 3 has a substantially rectangular shape in which an upper surface is opened, and an inner space thereof serves as an attachment space 30 of the one connector housing 1. In a bottom surface portion 31 becoming a lower surface of the attachment space 30, bolt insertion holes 32 shown in FIG. 26 are formed. By bolts 33 inserted into the bolt insertion holes 32, the other connector housing 3 is fixed to an unillustrated desired attachment surface.

Moreover, on the bottom surface portion 31 becoming the lower surface of the attachment space 30, terminal hood/housing portions 34 are integrally provided in a state of being protruded in the vertical direction. In the terminal hood/housing portions 34, a pair of power female terminals (terminals for power) 35 and 35 which are shown in FIGS. 20, 21A and 21B are individually housed. When the one connector housing 1 is lowered from above and moved closer to the other connector housing 3, the pair of power male terminals 9 and 9 of the one connector housing 1 enter the terminal hood/housing portions 34, and are brought into contact with the pair of power female terminals 35 and 35. Moreover, when the mutual power terminals 9 and 35 are in a contact state with each other and the one connector housing 1 is moved away from the other connector housing 3 and drawn upward, the pair of power male terminals 9 and 9 exit the terminal hood/housing portions 34, and are brought into non-contact with the pair of power female terminals 35 and 35.

Figure 22:
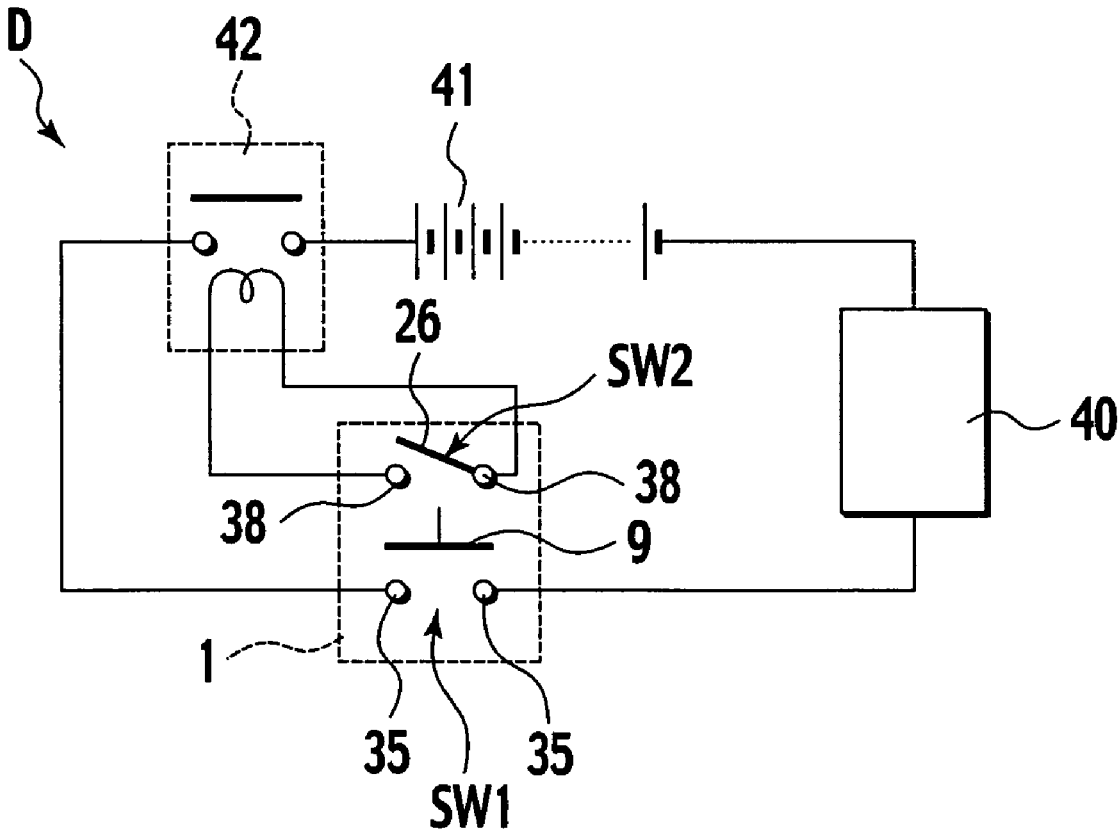
FIG. 22 shows the one embodiment of the present invention, and is a circuit diagram of a power supply circuit.

Moreover, to the respective power female terminals 35, one end sides of lead wires 39*a* are connected. One of the lead wires 39*a* and the other thereof are guided to a load unit 40 side of a power supply circuit D and a power supply unit 41 side of the power supply circuit D, respectively. Specifically, as shown in FIG. 22, a power switch SW1 of the power supply circuit D is composed of the power male terminals 9 and the power female terminals 35 of both of the connector housings 1 and 3.

Moreover, from the symmetric positions of an inner peripheral wall of the other connector housing 3, the pair of cam pins 36 and 36 are protruded. The pair of cam pins 36 and 36 are inserted into the cam grooves 21 of the lever 2 when the one connector housing 1 is attached to the other connector housing 3. Furthermore, on one side face portion of the other connector housing 3, a pair of bus bars 37 and 37 are arranged in parallel at an interval. Each of the bus bars 37 and 37 is formed of a conductive material high in rigidity and into a flat rod shape. Upper end portions of the pair of bus bars 37 and 37 are exposed to the outside from the other connector housing 3, and these exposed parts are formed as a pair of male terminals 38 and 38 which are fitting sensing terminals. Specifically, the pair of male terminals 38 and 38 are formed by utilizing the pair of bus bars 37 and 37. Then, a fitting sensing switch SW2 is composed of the pair of male terminals 38 and 38 and the short pin 26 of the lever 2. The fitting sensing switch SW2 is turned ON in a manner that the short pin 26 of the lever 2 is brought into contact with the pair of male terminals 38 and 38, and turned OFF in a non-contact state of the short pin 26 of the lever 2. To the pair of male terminals 38 and 38, lead wires 39*b* are individually connected, and both of the lead wires 39*b* are guided to a relay circuit 42 in the power supply circuit D.

Next, the power supply circuit D is described. As shown in FIG. 22, the power supply circuit D includes the load unit 40, and the power supply unit 41 which supplies electric power to the load unit 40. To the load unit 40 and the power supply unit 41, the power switch SW1, which is formed of the power terminals 9 and 35 of both of the connector housings 1 and 3, and the relay circuit 42, are connected in series. The relay circuit 42 is an electric circuit which is turned ON when the fitting sensing switch SW2 is ON and turned OFF when the fitting sensing switch SW2 is OFF. The power switch SW1 formed of the power terminals 9 and 35 of both of the connector housings 1 and 3 is a mechanical switch as described above.

Figure 29A:
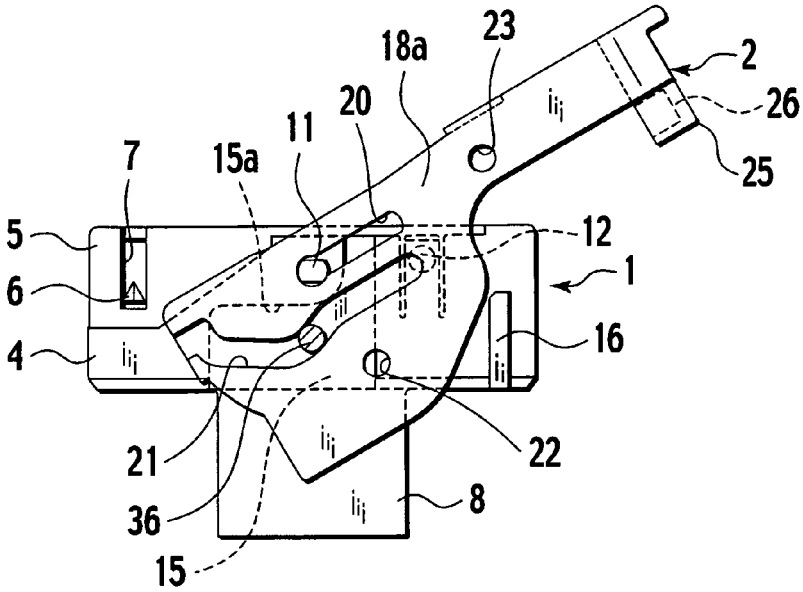
FIGS. 29A, 29B and 29C show the one embodiment of the present invention.
Figure 29B:
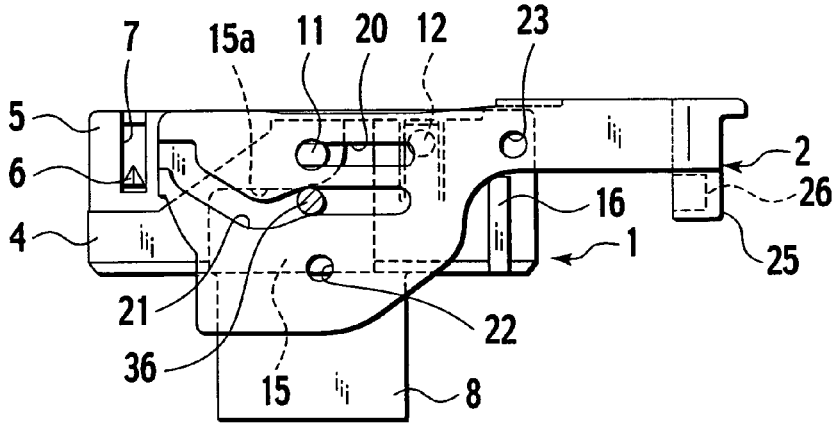
Figure 29C:
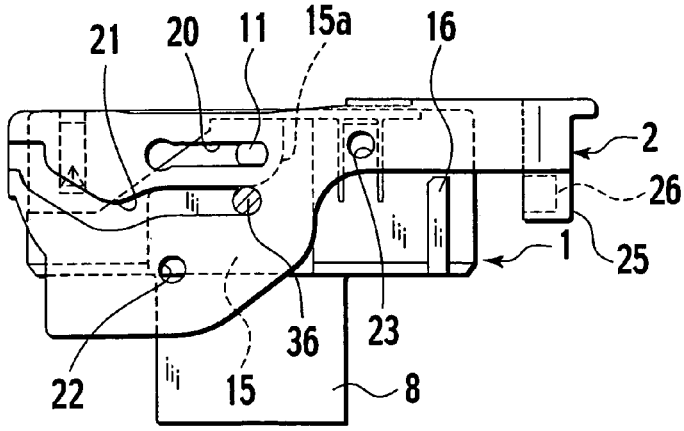
Figure 30A:
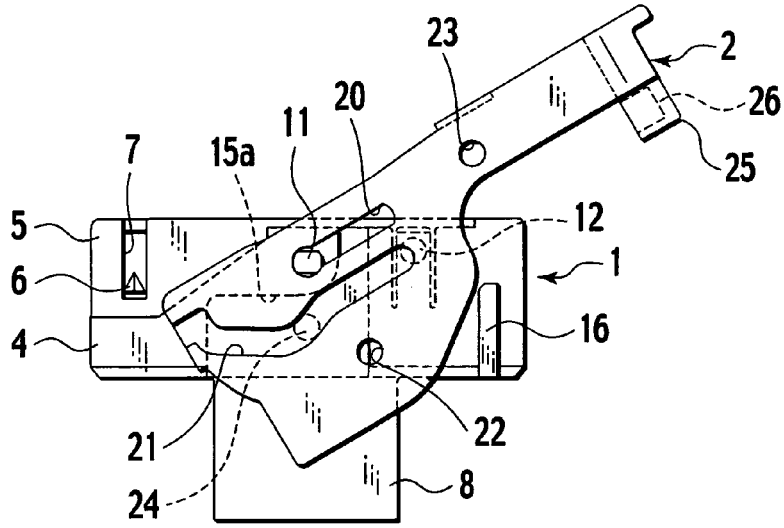
FIGS. 30A, 30B and 30C show the one embodiment of the present invention.
Figure 30B:
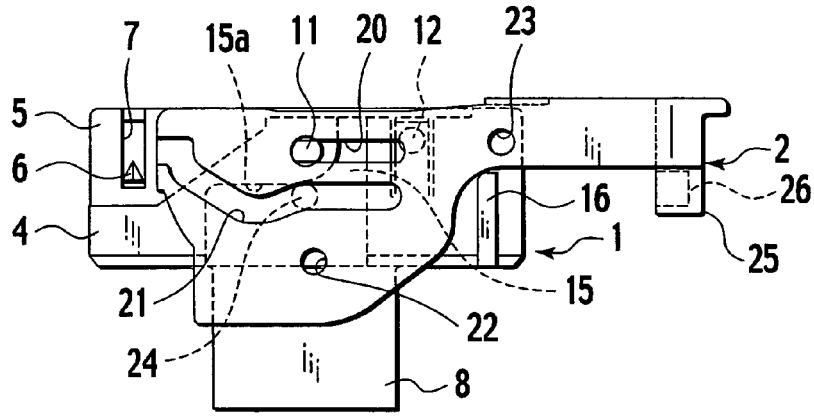
Figure 30C:
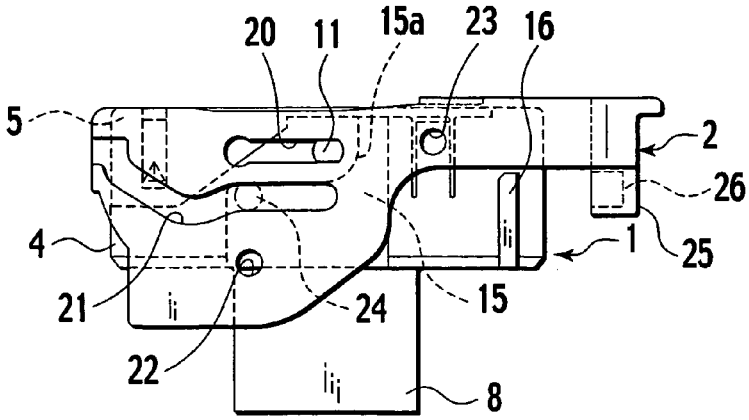

Next, an operation of the lever fitting-type power supply circuit breaker 1A is described with reference to FIGS. 23 to 30C. FIG. 23 is a perspective view showing a state before the one connector housing is temporarily fitted to the other connector housing. FIG. 24 is a perspective view showing a temporal connector-fitting position in a process of attaching the one connector housing to the other connector housing in a state where the lever is located at the operation start position. FIG. 25 is a partially cutaway front view showing the same position in the same state as those of FIG. 24. FIG. 26 is a cross-sectional view showing the same position in the same state as those of FIG. 24, in which the lever is omitted. FIG. 27 is a perspective view showing the temporal connector-fitting position in the process of attaching the one connector housing to the other connector housing in a state where the lever is located at the rotation completion position. FIG. 28 is a perspective view showing a state where the attachment of the one connector housing to the other connector housing is completed. FIG. 29A is a front view showing a state where the lever is located between the operation start position and the rotation completion position, explaining a moving process of cam pins when the one connector housing is attached to the other connector housing. FIG. 29B is a front view showing a state where the lever is located at the rotation completion position, explaining the moving process of the cam pins in a similar way to FIG. 29A. FIG. 29C is a front view showing a state where the lever is located at the operation completion position, explaining the moving process of the cam pins in a similar way to FIG. 29A. FIG. 30A is a front view showing a state where the lever is located between the operation start position and the rotation completion position, explaining a moving process of the lever-path adjusting guide pins when the one connector housing is attached to the other connector housing. FIG. 30B is a front view showing a state where the lever is located at the rotation completion position, explaining the moving process of the lever-path adjusting guide pins in a similar way to FIG. 30A. FIG. 30C is a front view showing a state where the lever is located at the operation completion position, explaining the moving process of the lever-path adjusting guide pins in a similar way to FIG. 30A.

First, an operation of bringing the power supply circuit D into a conductive state by the lever fitting-type power supply circuit breaker 1A is described. As shown in FIG. 23, the lever 2 is set at the operation start position, and the one connector housing 1 is inserted into the attachment space 30 from above the other connector housing 3. Then, the terminal hood portion 8 of the one connector housing 1 is inserted into the terminal hood/housing portion 34 of the other connector housing 3 while being fitted thereto. Moreover, the pair of cam pins 36 and 36 of the other connector housing 3 are inserted into the pair of cam grooves 21 and 21 of the lever 2. Then, as shown in FIGS. 24 and 25, the pair of cam pins 36 and 36 enter the respective opening portions 21*a* of the pair of cam grooves 21 and 21, and the pair of cam pins 36 and 36 are made to abut against the sidewall stopper surfaces 17 of the pair of cam grooves 21 and 21. Thus, both of the connector housings 1 and 3 are set at the temporal connector-fitting position. At this temporal connector-fitting position, the respective power terminals 9 and 35 of both of the connector housings 1 and 3 are not brought into contact with each other yet.

Next, when the lever 2 is rotated in a direction of an arrow A1 of FIG. 24, the lever 2 is rotated about the pair of guide pins 11 and 11 from the operation start position of FIG. 24 to the rotation completion position of FIG. 27. Moreover, as shown in FIG. 29A, the pair of cam pins 36 and 36 of the other connector housing 3 are moved in the pair of cam grooves 21 and 21 of the lever 2. Thus, the one connector housing 1 gradually approaches and enters the inside of the other connector housing 3. Then, the respective power terminals 9 and 35 of both of the connector housings 1 and 3 are brought into contact with each other before the lever 2 is located at the rotation completion position, and at the rotation completion position of the lever 2, both of the connector housings 1 and 3 reach the connector-fitting position.

Next, when the lever 2 is slid in a direction of an arrow B1 of FIG. 27, the pair of guide pins 11 and 11 are slid in the pair of guide grooves 20 and 20 of the lever 2. In addition, as shown in FIGS. 29B and 29C, the pair of cam pins 36 and 36 of the other connector housing 3 are slid in the pair of cam grooves 21 and 21 of the lever 2, and thus the lever 2 is slid (linearly moved) from the rotation completion position of FIG. 27 to the operation completion position of FIG. 28. The short pin 26 of the lever 2 is brought into contact with the pair of male terminals 38 and 38 of the other connector housing 3 before the lever 2 is located at the fitting completion position by the sliding movement. Then, when the fitting sensing switch SW2 is turned ON, the relay circuit 42 is turned ON, and thus the power supply circuit D is brought into the conductive state for the first time.

In the above-described operation, in the process of rotationally moving the lever 2 from the operation start position to the rotation completion position, the respective terminals 9 and 35 of both of the connector housings 1 and 3 are brought into the contact state with each other, and the power switch SW1 is turned ON, but the power supply circuit D is still non-conductive. In the process of sliding (linearly moving) the lever 2 from the rotation completion position to the operation completion position, the fitting sensing switch SW2 is turned ON, and thus the relay circuit 42 is turned ON to bring the power supply circuit D into the conductive state for the first time. Therefore, the power supply circuit D can be prevented from being brought into the conductive state halfway through the operation of the lever 2.

Next, an operation of bringing the power supply circuit D in the conductive state into a non-conductive state, that is, breaking the power supply by the lever fitting-type power supply circuit breaker 1A is described. In the state of FIG. 28, when the lever 2 is slid in a direction of an arrow B2 of FIG. 28, the pair of guide pins 11 and 11 are slid in the pair of guide grooves 20 and 20 of the lever 2, and the pair of cam pins 36 and 36 of the other connector housing 3 are slid in the pair of cam grooves 21 and 21 of the lever 2. Thus, the lever 2 is slid from the operation completion position of FIG. 28 to the rotation completion position of FIG. 27. Before the lever 2 is located at the rotation completion position by this sliding movement, the short pin 26 of the lever 2 is separated from the pair of male terminals 38 and 38 of the other connector housing 3, and is brought into the non-contact state therewith. Then, when the fitting sensing switch SW2 is turned OFF, the relay circuit 42 is turned OFF, and at this point of time, the power supply circuit D has already been brought into the non-conductive state.

Next, when the lever 2 is rotated in a direction of an arrow A2 of FIG. 27, the lever 2 is rotated about the pair of guide pins 11 and 11 from the rotation completion position of FIG. 27 to the operation start position of FIGS. 24 and 25. Moreover, the pair of cam pins 36 and 36 of the other connector housing 3 are moved in the pair of cam grooves 21 and 21 of the lever 2, and thus the one connector housing 1 is gradually moved upward so as to be separated from the other connector housing 3, and is drawn therefrom. Then, before the lever 2 is located at the operation start position, the respective power terminals 9 and 35 of both of the connector housings 1 and 3 are brought into the non-contact state with each other, and at the operation start position of the lever 2, both of the connector housings 1 and 3 are located at the temporal connector-fitting position.

In the above-described operation, in the process of linearly moving the lever 2 from the operation completion position to the rotation completion position, the fitting sensing switch SW2 is turned OFF, and thus the relay circuit 42 is turned OFF to bring the power supply circuit D into the non-conductive state. In the process of rotationally moving the lever 2 from the rotation completion position to the operation start position, the power switch SW1 between the respective power terminals 9 and 35 of both of the connector housings 1 and 3 is brought into a separated state. Thus, there is a time lag from the time when the power supply circuit D is turned OFF to the time when the power switch SW1 between the respective power terminals 9 and 35 of both of the connector housings 1 and 3 is separated, and a discharge time is sufficiently ensured. Therefore, an arc discharge between the respective power terminals 9 and 35 of both of the connector housings 1 and 3 can be prevented.

Note that, when it is desired to separate the one connector housing 1 completely from the other connector housing 3, the one connector housing 1 is taken out from above the other connector housing 3.

As described above, in the lever fitting-type power supply circuit breaker 1A, the fitting sensing switch SW2 is composed of the pair of fitting sensing male terminals 38 and 38 and the short pin 26, which can accordingly be installed in small installation spaces of the other connector housing 3 and the lever 2, respectively. Hence, the other connector housing 3 and the lever 2 can be downsized, and eventually, the lever fitting-type power supply circuit breaker 1A can be downsized. Moreover, a structure of the fitting sensing switch SW2 is simple, and accordingly, the fitting sensing switch SW2 can be manufactured at low cost.

In the above-described embodiment, the pair of male terminals 38 and 38 are formed by utilizing the pair of bus bars 37 and 37 arranged in the other connector housing 3, the short pin 26 is formed into the substantially U-shape, and a structure is constructed such that the short pin 26 sandwiches the pair of male terminals 38 and 38 from both outsides thereof to contact the same male terminals 38 and 38. Hence, the short pin 26 of the substantially U-shape can be brought into contact with the pair of bus bars 37 and 37 with large pressing force because the short pin 26 sandwiches the bus bars 37 and 37 to contact the same bus bars 37 and 37. Accordingly, a highly reliable conductive state can be obtained. Moreover, a linear stroke in which the short pin 26 is brought into contact/non-contact with the pair of male terminals 38 and 38 can be shortened as compared with that of the conventional male/female terminal structure, and accordingly, a stroke of the linear operation of the lever 2 can be shortened.

In the above-described embodiment, the lever 2 includes the pair of arm plate portions 18*a* and 18*b* arranged at an interval, and the operating portion 19 coupling the pair of arm plate portions 18*a* and 18*b* to each other, and the short pin 26 is provided in the operating portion 19. Accordingly, the short pin 26 can be installed without increasing the width of the lever 2.

Moreover, in the above-described embodiment, the cam grooves 21 and the cam pins 36 are provided in the lever 2 and the other connector housing 3, respectively. However, in a reverse order to this, the cam grooves 21 and the cam pins 36 may be provided in the other connector housing 3 and the lever 2, respectively. Thus, a degree of freedom in design will be enhanced. Furthermore, though the guide grooves 20 and the guide pins 11 are provided in the lever 2 and the one connector housing 1, respectively, the guide grooves 20 and the guide pins 11 may be provided in the one connector housing 1 and the lever 2, respectively, in the reverse order to the above. Thus, the degree of freedom in design is enhanced.

Furthermore, in the above-described embodiment, the lever 2 is provided in the one connector housing 1 so as to be freely rotationally movable and freely linearly movable, and the lever 2 is moved from the operation start position to the operation completion position by the rotational movement and the linear movement (sliding movement). However, the present invention is also applicable to one which moves the lever 2 from the operation start position to the operation completion position only by the rotational movement or one which moves the lever 2 from the operation start position to the operation completion position only by the linear movement (sliding movement). A device, in which the lever 2 moves from the operation start position to the operation completion position only by the rotational movement, is formed such that the power switch is turned ON in a first half of the rotational movement process of the lever 2, and that the fitting sensing switch SW2 is turned ON in a second half of the rotational movement process.

What is claimed is:

1. A lever fitting-type power supply circuit breaker, comprising:

a first connector housing comprising a lever provided for moving between an operation start position and an operation completion position; and a second connector housing fittable to the first connector housing, wherein the first and second connector housings individually provide power terminals forming a power switch therein, fitting sensing terminals forming a fitting sensing switch are individually provided in the lever and the second connector housing, the fitting sensing terminal provided in the second connector housing is formed of a pair of male terminals, and the fitting sensing terminal provided in the lever is formed of a short pin, and when the lever is operated from the operation start position to the operation completion position in a state where the first and second connector housings are set at a temporal connector-fitting position, the first and second connector housings move from the temporal connector-fitting position to a connector-fitting position, and the power terminals are brought into contact with each other to turn ON the power switch, and thereafter, both of the fitting sensing terminals are brought into contact with each other to turn ON the fitting sensing switch, and a power supply circuit is brought into a conductive state by the turning ON of the fitting sensing switch.

2. The lever fitting-type power supply circuit breaker according to claim 1, wherein the pair of male terminals are formed by utilizing a pair of bus bars arranged in the second connector housing, the short pin is formed into a substantially U-shape, and the short pin sandwiches the pair of male terminals from both outsides thereof to contact the male terminals.

3. The lever fitting-type power supply circuit breaker according to claim 1, wherein the lever comprises a pair of arm plate portions arranged at an interval and an operating portion coupling the pair of arm plate portions to each other, and the short pin is provided in the operating portion.

4. The lever fitting-type power supply circuit breaker according to claim 1, wherein the movement of the lever from the operation start position to the operation completion position is composed of a rotational movement and a linear movement, both of the power terminals are brought into contact with each other in a process of the rotational movement, and the pair of male terminals and the short pin are brought into contact with each other in a process of the linear movement.

* * * * *